US009561575B2

(12) United States Patent
Motoshima et al.

(10) Patent No.: US 9,561,575 B2
(45) Date of Patent: Feb. 7, 2017

(54) ADJUSTING A SUBSTRATE POLISHING CONDITION

(71) Applicant: EBARA CORPORATION, Tokyo (JP)

(72) Inventors: Yasuyuki Motoshima, Tokyo (JP); Toru Maruyama, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/964,132

(22) Filed: Dec. 9, 2015

(65) Prior Publication Data

US 2016/0096250 A1 Apr. 7, 2016

Related U.S. Application Data

(63) Continuation of application No. 14/034,495, filed on Sep. 23, 2013, now Pat. No. 9,233,448.

(30) Foreign Application Priority Data

Sep. 24, 2012 (JP) ..... 2012-209275
Sep. 17, 2013 (JP) ..... 2013-192105

(51) Int. Cl.

| | |
|---|---|
| ***B24B 37/005*** | (2012.01) |
| ***B24B 9/06*** | (2006.01) |
| *B24B 49/03* | (2006.01) |
| *B24B 49/14* | (2006.01) |

(52) U.S. Cl.

CPC ..... *B24B 37/005* (2013.01); *B24B 9/065* (2013.01); *B24B 49/03* (2013.01); *B24B 49/14* (2013.01)

(58) Field of Classification Search

CPC ..... B24B 1/00; B24B 9/065; B24B 29/00; B24B 37/005; B24B 37/015; B24B 37/24; B24B 49/03; B24B 49/14; B24B 51/00

See application file for complete search history.

(56) References Cited

U.S. PATENT DOCUMENTS

| | | | |
|---|---|---|---|
| 7,306,506 | B2 | 12/2007 | Elledge |
| 8,257,142 | B2 | 9/2012 | Muldowney et al. |
| 2005/0020082 | A1 | 1/2005 | Vishwanathan et al. |
| 2006/0196283 | A1 | 9/2006 | Yang |
| 2010/0086864 | A1 | 4/2010 | Kojima et al. |
| 2012/0190273 | A1 | 7/2012 | Ono |
| 2013/0331014 | A1 | 12/2013 | Shiro et al. |

FOREIGN PATENT DOCUMENTS

| | | |
|---|---|---|
| JP | 2012-148376 | 8/2012 |

*Primary Examiner* — Timothy V Eley
(74) *Attorney, Agent, or Firm* — Baker & Hostetler LLP

(57) ABSTRACT

A polishing apparatus polishes a substrate by moving the substrate and a polishing pad relative to each other. The apparatus includes: an elastic modulus measuring device configured to measure an elastic modulus of the polishing pad, and a polishing condition adjustor configured to adjust polishing conditions of the substrate based on a measured value of the elastic modulus. The polishing conditions include pressure of a retaining ring, arranged around the substrate, exerted on the polishing pad and a temperature of the polishing pad.

11 Claims, 22 Drawing Sheets

ADJUSTING A SUBSTRATE POLISHING CONDITION

CROSS REFERENCE TO RELATED APPLICATIONS

This application is a continuation application of U.S. application Ser. No. 14/034,495 filed Sep. 23, 2013, which claims priority to Japanese Patent Application No. 2012-209275 filed Sep. 24, 2012 and Japanese Patent Application No. 2013-192105 filed Sep. 17, 2013, the entire contents of which are hereby incorporated by reference.

BACKGROUND OF THE INVENTION

Field of the Invention

The present invention relates to a polishing method and a polishing apparatus for polishing a substrate, such as a wafer, and more particularly to a polishing method and a polishing apparatus that change a polishing condition in accordance with an elastic modulus of a polishing pad which is used in polishing the substrate.

Description of the Related Art

A CMP (chemical mechanical polishing) apparatus polishes a surface of a wafer by providing sliding contact between the wafer and a polishing pad in the presence of a polishing liquid, while pressing the wafer against the polishing pad. The polishing pad is formed from an elastic material, such as porous polyurethane. A top surface of the polishing pad provides a polishing surface for polishing the wafer, which is placed in sliding contact with this polishing surface.

The polishing surface of the polishing pad is regularly processed by a pad dresser (or a pad conditioner). This pad dresser has a dressing surface having abrasive gains, such as diamond particles, fixed thereto. The pad dresser presses this dressing surface against the polishing pad while rotating the dressing surface to scrape away the surface of the polishing pad slightly to thereby restore the polishing surface. As the dressing process (or the conditioning process) is repeated, the polishing pad becomes thinner gradually. Further, as the polishing of the wafer is repeated, the polishing liquid gradually soaks into cells formed in the polishing pad. As a result, an elastic modulus of the polishing pad changes.

The elastic modulus of the polishing pad is a value of physical property representing a difficulty of being deformed when a force is applied to the polishing pad. Specifically, a higher elastic modulus indicates a harder polishing pad. The elastic modulus of the polishing pad depends not only on a thickness of the polishing pad and the existence of the polishing liquid that has soaked into the polishing pad, but also on a temperature of the polishing pad. Typically, the polishing pad is made of resin as described above. Therefore, as the temperature of the polishing pad increases, the polishing pad becomes soft.

The elastic modulus of the polishing pad greatly affects a polishing profile of the wafer. In particular, when the polishing pad is soft, the wafer, which is pressed against the polishing pad, sinks into the polishing pad. As a result, a peripheral portion of the wafer is excessively polished as compared with other portions of the wafer. This is a so-called rounded edge. In order to prevent such an undesired polishing result, it is preferable to change wafer polishing conditions based on the elastic modulus of the polishing pad.

In a conventional technique, the elastic modulus of the polishing pad is measured so that a remaining lifetime of the polishing pad is determined or conditions of the dressing process are adjusted based on the elastic modulus (see U.S. patent document US 2006/0196283). However, the conventional technique does not provide the use of the measured elastic modulus for adjusting the polishing conditions of the wafer.

It has been proposed to measure the temperature of the polishing pad and to estimate the elastic modulus of the polishing pad from the measured pad temperature (for example see Japanese laid-open patent publication No. 2012-148376). However, the elastic modulus of the polishing pad depends not only on the temperature of the polishing pad, but also on other factors as described above. Therefore, the estimated elastic modulus of the polishing pad can be different from an actual elastic modulus.

SUMMARY OF THE INVENTION

The present invention has been made in view of the above-described drawback. It is therefore an object of the present invention to provide a polishing method and a polishing apparatus that adjusts a polishing condition based on an elastic modulus of a polishing pad during or after polishing of a substrate, such as a wafer.

An embodiment for achieving the above object is a polishing method for polishing a substrate by moving the substrate and a polishing pad relative to each other. The method includes: measuring an elastic modulus of the polishing pad; and adjusting a polishing condition of the substrate based on a measured value of the elastic modulus.

An embodiment for achieving the above object is a polishing apparatus for polishing a substrate by moving the substrate and a polishing pad relative to each other. The apparatus includes: an elastic modulus measuring device configured to measure an elastic modulus of the polishing pad, and a polishing condition adjustor configured to adjust a polishing condition of the substrate based on a measured value of the elastic modulus.

According the above embodiments, the polishing condition is adjusted based on the actually measured elastic modulus of the polishing pad. Therefore, a good substrate polishing result can be achieved.

DETAILED DESCRIPTION

Embodiments will now be described with reference to the drawings.

Figure 1:
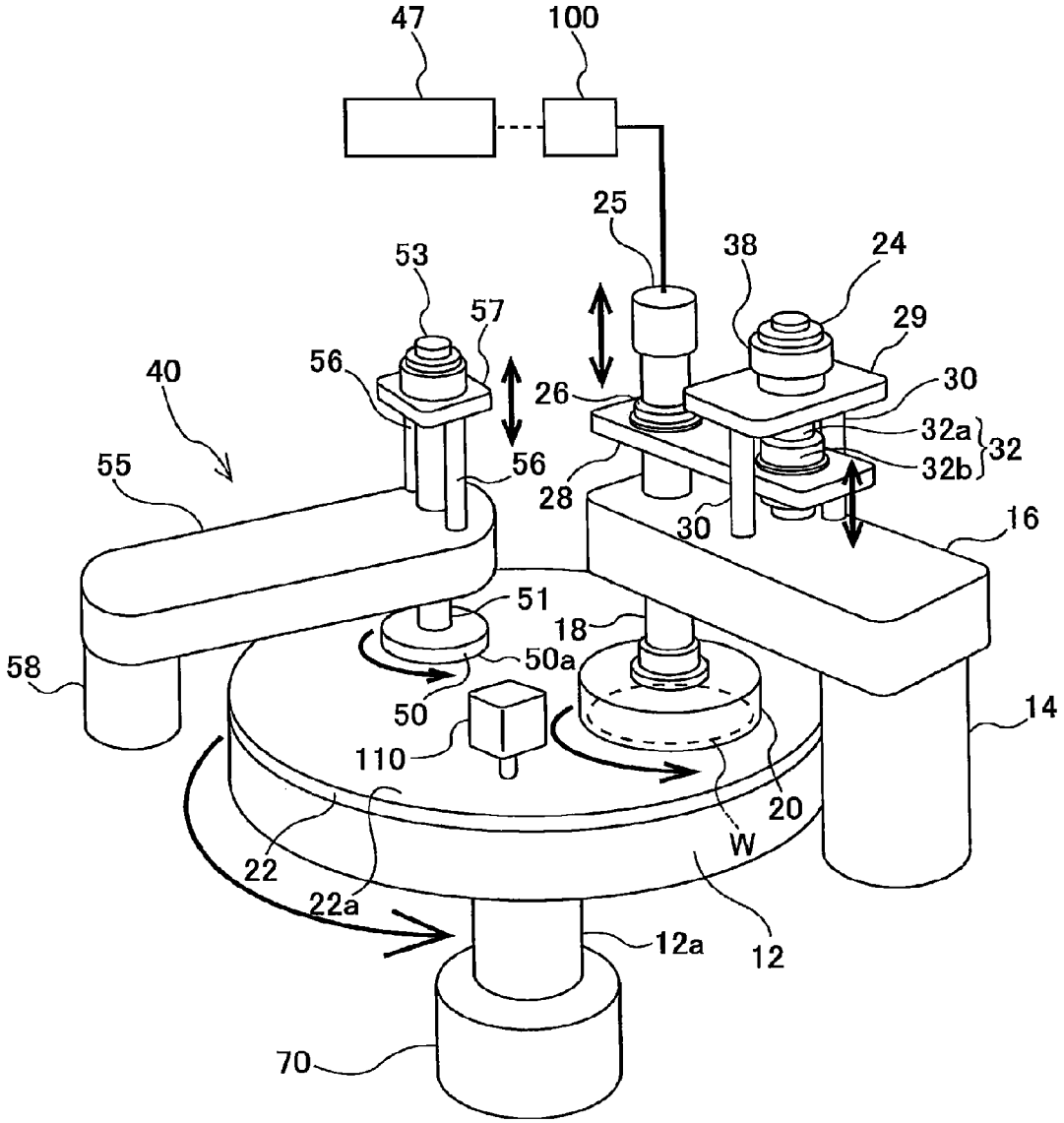
FIG. 1 is a schematic view of an embodiment of a polishing apparatus.

FIG. 1 is a schematic view of a polishing apparatus according to an embodiment. As shown in FIG. 1, the polishing apparatus has a polishing table 12, a top ring arm 16 coupled to an upper end of a support shaft 14, a top ring shaft 18 mounted to a free end of the top ring arm 16, a top ring 20 coupled to a lower end of the top ring shaft 18, and a polishing condition adjustor 47 for adjusting a polishing condition of a substrate, such as a wafer. The top ring shaft 18 is coupled to a top ring motor (not shown) disposed in the top ring arm 16, so that the top ring shaft 18 is rotated by the top ring motor. This rotation of the top ring shaft 18 causes the top ring 20 to rotate in a direction indicated by arrow.

The polishing table 12 is coupled to a table motor 70 through a table shaft 12*a*, so that the polishing table 12 is rotated about the table shaft 12*a* by the table motor 70 in a direction indicated by arrow. The table motor 70 is disposed below the polishing table 12. A polishing pad 22 is attached to an upper surface of the polishing table 12. The polishing pad 22 has an upper surface 22*a* that provides a polishing surface for polishing a substrate, such as a wafer.

The top ring shaft 18 is moved up and down relative to the top ring arm 16 by an elevating mechanism 24. This vertical movement of the top ring shaft 18 causes the top ring 20 to move up and down relative to the top ring arm 16. A rotary joint 25 is mounted to an upper end of the top ring shaft 18. A pressure regulator 100 is coupled to the top ring 20 through the rotary joint 25.

The top ring 20 is configured to hold a wafer on its lower surface. The top ring arm 16 is able to pivot on the support shaft 14. Thus, the top ring 20, which holds the wafer on its lower surface, is moved between a position at which the top ring 20 receives the wafer and a position above the polishing table 12 by the pivotal movement of the top ring arm 16. The top ring 20 is lowered and presses the wafer against the upper surface (i.e., the polishing surface) 22*a* of the polishing pad 22. During polishing of the wafer, the top ring 20 and the polishing table 12 are respectively rotated, while a polishing liquid is supplied onto the polishing pad 22 from a polishing liquid supply nozzle (not shown) provided above the polishing table 12. In this manner, the wafer is placed in sliding contact with the polishing surface 22*a* of the polishing pad 22, so that a surface of the wafer is polished.

The elevating mechanism 24 for vertically moving the top ring shaft 18 and the top ring 20 has a bridge 28 rotatably supporting the top ring shaft 18 through a bearing 26, a ball screw 32 mounted to the bridge 28, a support stage 29 supported by pillars 30, and an AC servomotor 38 provided on the support stage 29. The support stage 29, which supports the servomotor 38, is coupled to the top ring arm 16 through the pillars 30.

The ball screw 32 has a screw shaft 32*a* which is coupled to the servomotor 38, and a nut 32*b* which engages with the screw shaft 32*a*. The top ring shaft 18 is configured to be movable vertically (i.e., move up and down) together with the bridge 28. Accordingly, when the servomotor 38 is set in motion, the bridge 28 is moved vertically through the ball screw 32. As a result, the top ring shaft 18 and the top ring 20 are moved vertically.

The polishing apparatus has a dressing unit 40 for dressing the polishing surface 22*a* of the polishing pad 22. The dressing unit 40 includes a dresser 50 which is brought into sliding contact with the polishing surface 22*a* of the polishing pad 22, a dresser shaft 51 to which the dresser 50 is coupled, a pneumatic cylinder 53 mounted to an upper end of the dresser shaft 51, and a dresser arm 55 rotatably supporting the dresser shaft 51. The dresser 50 has a lower surface that provides a dressing surface 50*a*, which is formed by abrasive grains (e.g., diamond particles). The pneumatic cylinder 53 is disposed on a support stage 57, which is supported by pillars 56. The pillars 56 are fixed to the dresser arm 55.

The dresser arm 55 is configured to pivot on the support shaft 58 by actuation of a motor (not shown). The dresser shaft 51 is rotated by actuation of a motor (not shown). Thus, the dresser 50 is rotated about the dresser shaft 51 by the rotation of the dresser shaft 51. The pneumatic cylinder 53 moves the dresser 50 vertically through the dresser shaft 51 so as to press the dresser 50 against the polishing surface 22*a* of the polishing pad 22 at a predetermined pressing force.

Dressing of the polishing surface 22*a* of the polishing pad 22 is performed as follows. The dresser 50 is rotated about the dresser shaft 51, while pure water is supplied onto the polishing surface 22*a* from a pure water supply nozzle (not shown). In this state, the dresser 50 is pressed against the polishing surface 22*a* by the pneumatic cylinder 53, so that the dressing surface 50*a* is placed in sliding contact with the polishing surface 22*a*. Further, the dresser arm 55 pivots around the support shaft 58 so that the dresser 50 oscillates in a radial direction of the polishing surface 22*a*. In this manner, the polishing pad 22 is scraped by the dresser 50, and thus the polishing surface 22*a* is dressed (i.e., restored).

Figure 2:
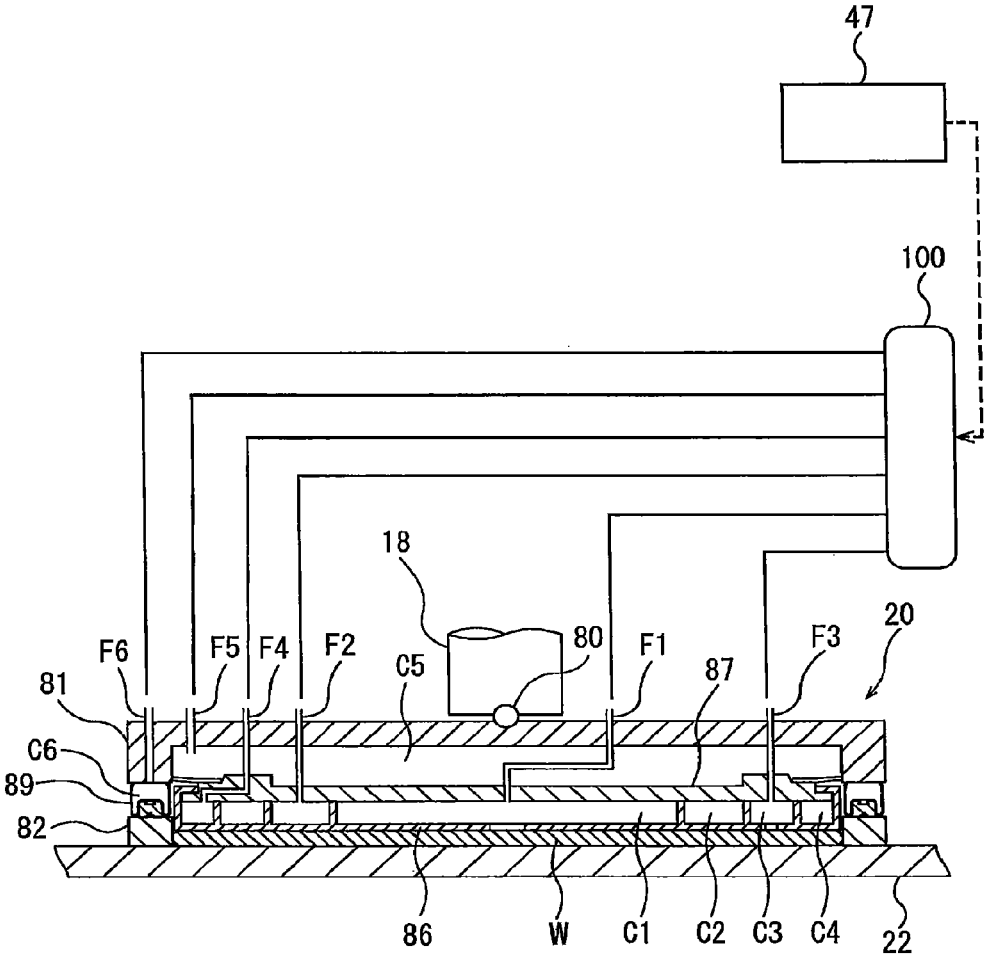
FIG. 2 is a cross-sectional view of a top ring having a plurality of air bags capable of pressing multiple zones of a wafer independently.

FIG. 2 is a cross-sectional view showing the top ring 20 having multiple air bags capable of pressing plural zones of a wafer W independently. The top ring 20 has a top ring body 81 coupled to the top ring shaft 18 through a universal joint 80, and a retaining ring 82 provided below the top ring body 81.

The top ring 20 further has a flexible membrane (or an elastic membrane) 86 to be brought into contact with the wafer W, and a chucking plate 87 that holds the membrane 86. The membrane 86 and the chucking plate 87 are disposed below the top ring body 81. Four pressure chambers (i.e., air bags) C1, C2, C3, and C4 are provided between the membrane 86 and the chucking plate 87. The pressure chambers C1, C2, C3, and C4 are formed by the membrane 86 and the chucking plate 87. The central pressure chamber C1 has a circular shape, and the other pressure chambers C2, C3, and C4 have an annular shape. These pressure chambers C1, C2, C3, and C4 are in a concentric arrangement.

Pressurized gas (i.e., pressurized fluid), such as pressurized air, is supplied into the pressure chambers C1, C2, C3, and C4 from the pressure regulator 100 through fluid passages F1, F2, F3, and F4, respectively. The pressures in the pressure chambers C1, C2, C3, and C4 can be changed independently to thereby independently regulate polishing pressures applied to the corresponding four zones of the wafer W: a central zone, an inner intermediate zone, an outer intermediate zone, and a peripheral zone.

A pressure chamber C5 is formed between the chucking plate 87 and the top ring body 81. The pressurized gas is supplied into the pressure chamber C5 from the pressure regulator 100 through a fluid passage F5. With this operation, the chucking plate 87 and the membrane 86 in their entirety can move vertically. The retaining ring 82 is arranged around the peripheral portion of the wafer W so as to prevent the wafer W from coming off the top ring 20 during polishing of the wafer W. The membrane 86 has an opening in a portion that forms the pressure chamber C3, so that the wafer W can be held by the top ring 20 via the vacuum suction by producing a vacuum in the pressure chamber C3. Further, the wafer W can be released from the top ring 20 by supplying nitrogen gas, clean air, or the like into the pressure chamber C3.

An annular rolling diaphragm 89 is provided between the top ring body 81 and the retaining ring 82. A pressure chamber C6 is formed in the rolling diaphragm 89. The pressure chamber C6 is coupled to the above-described pressure regulator 100 through a fluid passage F6. The pressure regulator 100 supplies the pressurized gas into the pressure chamber C6, so that the retaining ring 82 presses the polishing pad 22.

The pressurized gas from the pressure regulator 100 is supplied into the pressure chambers C1 to C6 through the fluid passages F1, F2, F3, F4, F5, and F6, respectively. The pressure chambers C1 to C6 are also coupled to vent valves (not shown), respectively, so that the pressure chambers C1 to C6 can be ventilated to the atmosphere.

The polishing condition adjustor 47 is configured to determine target values of the pressures in the pressure chambers C1, C2, C3, and C4 based on the progress of polishing at film thickness measurement points which are located at positions corresponding to the pressure chambers C1, C2, C3, and C4. The polishing condition adjustor 47 sends command signal to the pressure regulator 100 and controls the pressure regulator 100 such that the pressures in the pressure chambers C1, C2, C3, and C4 are maintained at the above-described target values, respectively. The top ring 20 having the multiple pressure chambers can polish a film of the wafer uniformly because the pressure chambers can independently press the respective zones of the surface of the wafer W against the polishing pad 22 according to the progress of polishing.

Since the wafer W is polished while being pressed against the polishing pad 22, a polishing result can vary depending on an elastic modulus of the polishing pad 22. The elastic modulus is a value of physical property representing a difficulty of being deformed when a force is applied to the polishing pad 22. Specifically, a harder polishing pad 22 has a higher elastic modulus, while a softer polishing pad 22 has a lower elastic modulus.

Figure 3A:
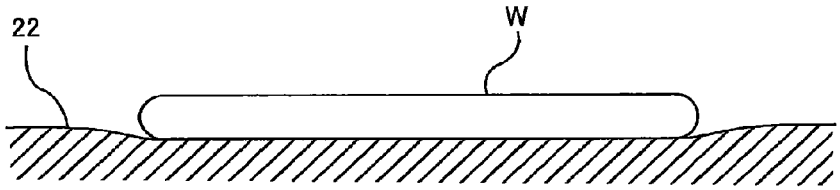
FIG. 3A is a diagram for illustrating an effect of an elastic modulus of a polishing pad on a polishing process of the wafer.
Figure 3B:
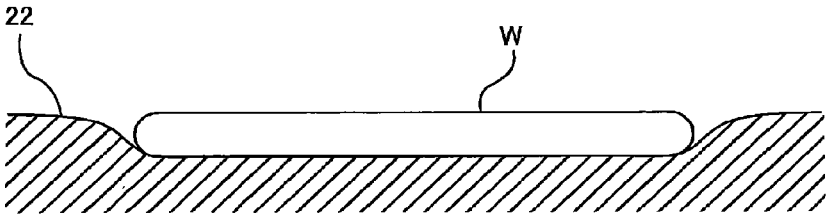
FIG. 3B is a diagram for illustrating an effect of an elastic modulus of a polishing pad on a polishing process of the wafer.

FIG. 3A and FIG. 3B are diagrams each illustrating an effect of the elastic modulus of the polishing pad 22 on a polishing process of the wafer W. As shown in FIG. 3A, when the polishing pad 22 is hard, the wafer W does not sink deeply into the polishing pad 22. As a result, a small area of the polishing pad 22 contacts the peripheral portion of the wafer W. In contrast, as shown in FIG. 3B, when the polishing pad 22 is soft, the wafer W sinks into the polishing pad 22. As a result, a large area of the polishing pad 22 contacts the peripheral portion of the wafer W, thus causing so-called rounded edge which means that the peripheral portion of the wafer W is polished excessively as compared with other portions of the wafer W.

Figure 4:
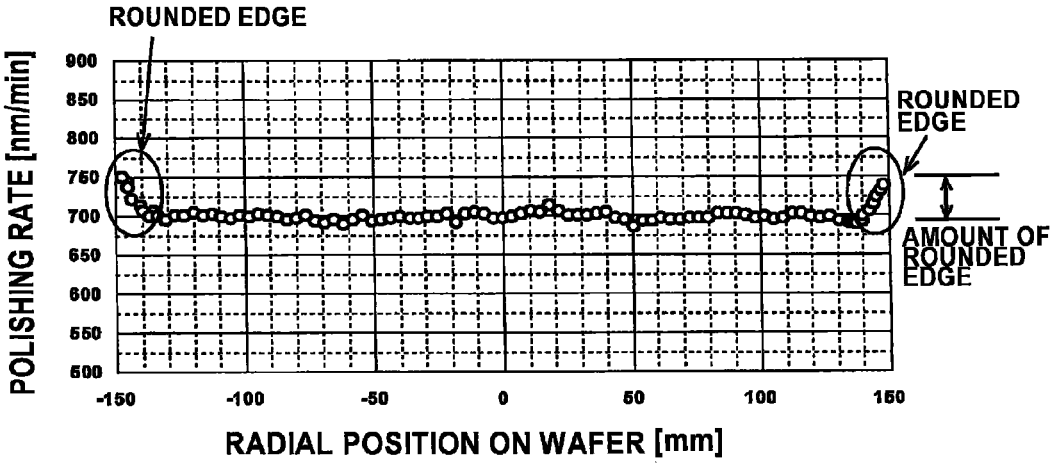
FIG. 4 is a diagram showing a polishing rate of the wafer that has been polished with use of a soft polishing pad.

FIG. 4 is a diagram showing a polishing rate of the wafer W that has been polished with use of a soft polishing pad 22. A graph shown in FIG. 4 represents the polishing rate (which is also referred to as a removal rate) at each of positions arranged in the radial direction of the wafer W. It can be seen from FIG. 4 that the polishing rate in the peripheral portion of the wafer W is higher than that in other portions. That is, the peripheral portion of the wafer W is polished more excessively than in other portions. As a result, the rounded edge occurs.

In order to prevent such rounded edge, the retaining ring 82, which is arranged around the wafer W, is used to press a region of the polishing pad 22 lying outwardly of the wafer W, as shown in FIG. 2. Since the retaining ring 82 presses the polishing pad 22 downwardly around the wafer W, it is possible to reduce a contact area between the polishing pad 22 and the peripheral portion of the wafer W. As a result, the rounded edge can be prevented.

Figure 5:
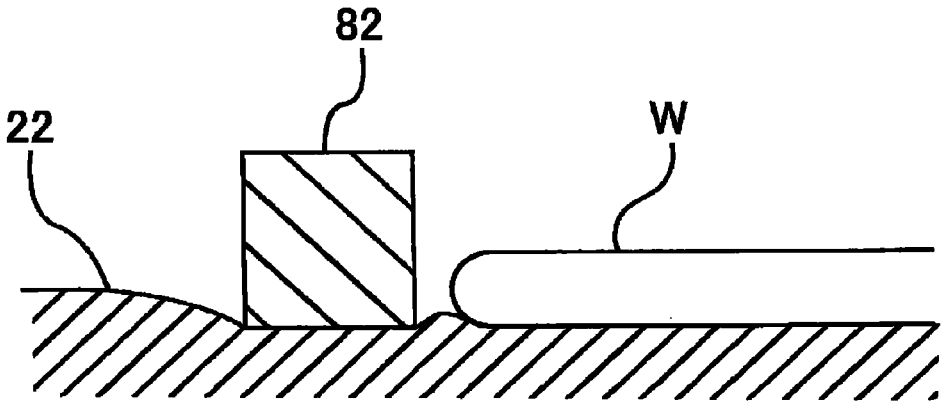
FIG. 5 is a view showing the soft polishing pad.
Figure 6:
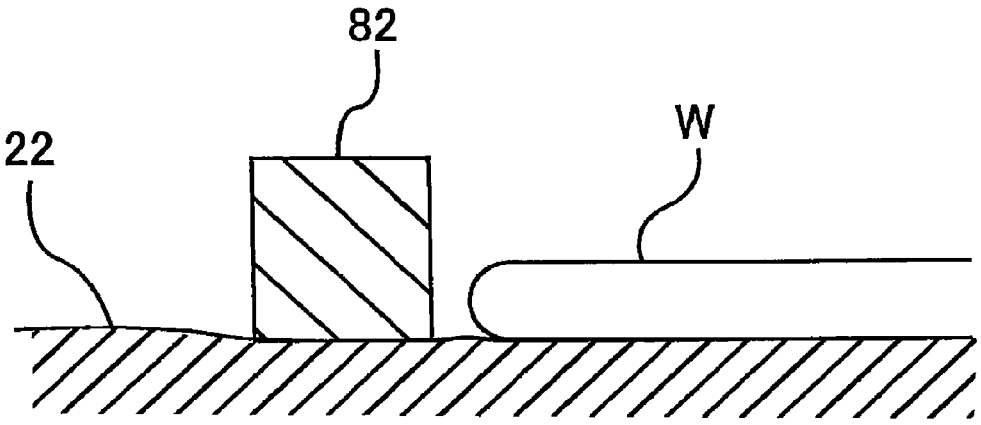
FIG. 6 is a view showing a hard polishing pad.

However, as shown in FIG. 5, when the polishing pad 22 is soft, a portion of the polishing pad 22 located between the retaining ring 82 and the wafer W may rise. In such a case, the pressure of the retaining ring 82 exerted on the polishing pad 22 is increased so as to reduce the contact area between the wafer W and the polishing pad 22. When the polishing pad 22 is hard, the polishing pad 22 does not rise so high, as shown in FIG. 6. Therefore, in this case, the pressure of the retaining ring 82 is increased slightly. In this manner, it is necessary to adjust the pressure of the retaining ring 82 during polishing of the wafer W in accordance with the elastic modulus of the polishing pad 22.

The elastic modulus of the polishing pad 22 can vary depending on a temperature of the polishing pad 22. Therefore, it is possible to prevent the rounded edge of the polishing pad 22 by changing not only the pressure of the retaining ring 82, but also the temperature of the polishing pad 22.

The elastic modulus of the polishing pad 22 affects not only the rounded edge of the wafer W, but also erosion and dishing. More specifically, when the polishing pad 22 is soft, a pattern region (i.e., a high density area where interconnects 101 are formed) is removed greatly as compared with other regions (i.e., the erosion), or a dish-shaped recess is formed on the interconnect 101 which is formed in a dielectric film 102 (i.e., the dishing). Such erosion and dishing are less likely to occur when the polishing pad 22 is hard. Therefore, when the polishing pad 22 is soft, it is possible to prevent the erosion and the dishing by changing the temperature of the polishing pad 22. In this manner, it is preferable to change polishing conditions, such as the pressure of the retaining ring 82 and the temperature of the polishing pad 22, based on the elastic modulus of the polishing pad 22.

Thus, in this embodiment, the elastic modulus of the polishing pad 22 is measured during polishing of the wafer or before polishing of the wafer, and the polishing conditions of the wafer are adjusted based on the measured value of the elastic modulus. As shown in FIG. 1, the polishing apparatus has an elastic modulus measuring device 110 for measuring the elastic modulus of the polishing pad 22. This elastic modulus measuring device 110 is configured to apply a force to the polishing pad 22 to deform the polishing pad 22 and measure the elastic modulus of the polishing pad 22 from an amount of deformation of the polishing pad 22.

Figure 8:
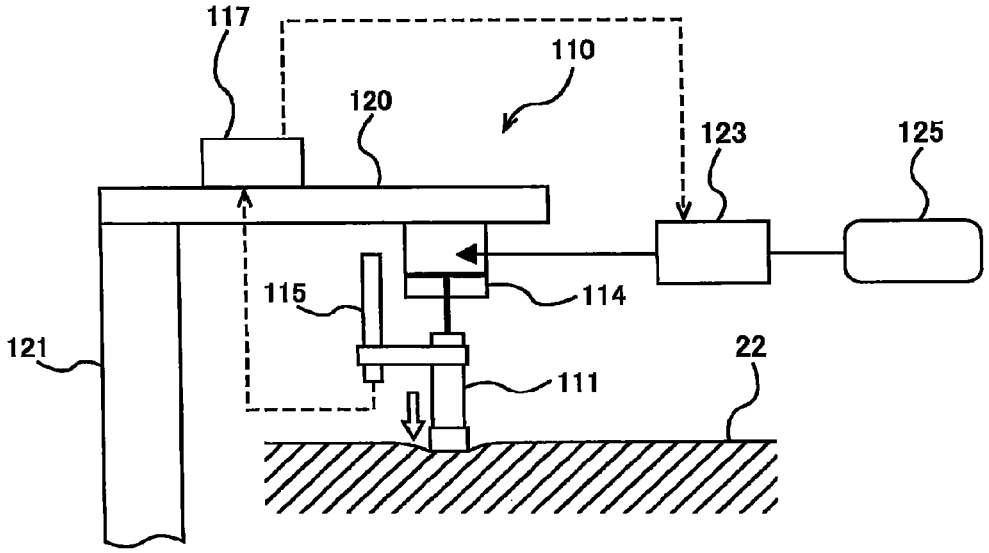
FIG. 8 is a schematic view showing an example of an elastic modulus measuring device for measuring the elastic modulus of the polishing pad.

FIG. 8 is a schematic view showing an example of the elastic modulus measuring device 110. This elastic modulus measuring device 110 has a contact member 111 to be brought into contact with the polishing pad 22, an pneumatic cylinder 114 as an actuator for pressing the contact member 111 against the polishing pad 22, a displacement measuring device 115 for measuring a displacement of the contact member 111, and an elastic modulus determiner 117 for determining the elastic modulus of the polishing pad 22 from the displacement of the contact member 111 and a load of the contact member 111 exerted on the polishing pad 22. The pneumatic cylinder 114 is secured to a support arm 120 arranged above the polishing pad 22. The support arm 120 is secured to a support shaft 121 which is provided outside the polishing table 12. The pneumatic cylinder 114 may be secured to the dresser arm 55, instead of the support arm 120.

The pneumatic cylinder 114 is coupled to a compressed-gas supply source 125 via a pressure regulator 123, which is configured to regulate pressure of a compressed gas supplied from the compressed-gas supply source 125 and deliver the compressed gas with the regulated pressure to the pneumatic cylinder 114. The elastic modulus determiner 117 is operable to send a predetermined target pressure value of the compressed gas to the pressure regulator 123, and the pressure regulator 123 operates such that the pressure of the compressed gas delivered to the pneumatic cylinder 114 is maintained at the predetermined target pressure value. The load applied from the contact member 111 to the polishing pad 22 can be calculated from the target pressure value and a pressure-receiving area of the pneumatic cylinder 114.

The displacement measuring device 115 is configured to move vertically together with the contact member 111 relative to the support arm 120. Since a height of the support arm 120 is constant, the displacement of the contact member 111 can be determined by measuring the displacement of the displacement measuring device 115 relative to the support arm 120. The pneumatic cylinder 114 presses the contact member 111 against the polishing pad 22, and in this state the displacement measuring device 115 measures the displacement of the contact member 111, i.e., the amount of deformation of the polishing pad 22. Thus, the displacement measuring device 115 serves as a pad deformation measuring device for measuring the amount of deformation of the polishing pad 22. The displacement measuring device 115 may be of contact type or non-contact type. For example, a linear scale, a laser sensor, an ultrasonic sensor, or an eddy current sensor may be used as the displacement measuring device 115. A distance sensor for measuring a distance between two points may also be used as the displacement measuring device 115.

The pneumatic cylinder 114 is configured to press the contact member 111 against the polishing pad 22 at a predetermined force to thereby deform the surface of the polishing pad 22. The displacement measuring device 115 measures the displacement of the contact member 111 (i.e., the amount of deformation of the polishing pad 22). The displacement of the contact member 111 when pressed against the polishing pad 22 varies in accordance with the elastic modulus of the polishing pad 22. Therefore, the elastic modulus of the polishing pad 22 can be determined from the displacement of the contact member 111. The contact member 111 may preferably have a tip end made of a hard resin, such as PPS (polyphenylene sulfide) or PEEK (polyether ether ketone).

Figure 9:
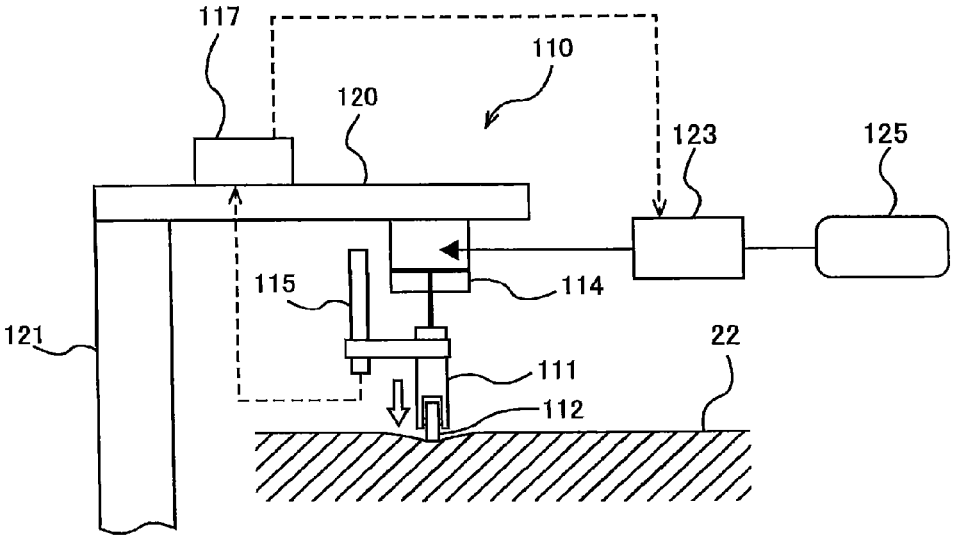
FIG. 9 is a view showing a modified example of the elastic modulus measuring device shown in FIG. 8.

The elastic modulus of the polishing pad 22 can vary even during polishing of the wafer. Therefore, the elastic modulus of the polishing pad 22 may be measured during polishing of the wafer. In this case, in order to prevent a damage to the contact member 111 when contacting the rotating polishing pad 22, the contact member 111 may have a rotatable roller 112 mounted to a tip end of the contact member 111, as shown in FIG. 9. This structure can prevent not only the damage to the contact member 111, but also a damage to the polishing pad 22 due to the contact with the contact member 111.

Figure 10:
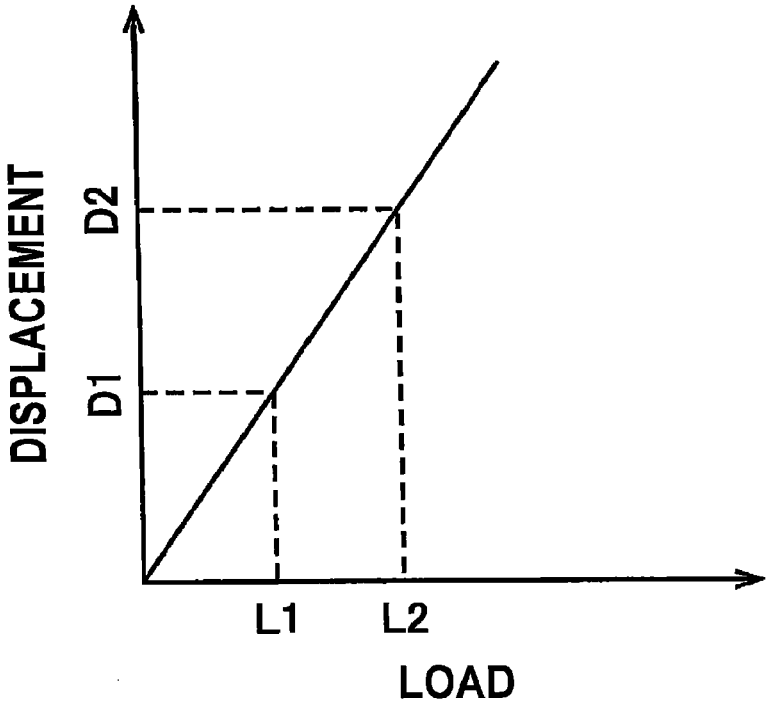
FIG. 10 is a diagram showing a relationship between load of a contact member and displacement of the contact member.

The displacement of the contact member 111 (i.e., the amount of deformation of the polishing pad 22) when the contact member 111 is pressed against the polishing pad 22 depends on the load of the contact member 111 on the polishing pad 22 and the elastic modulus of the polishing pad 22. Under a condition that the elastic modulus is constant, the displacement of the contact member 111 is proportional to the load of the contact member 111 exerted on the polishing pad 22. FIG. 10 is a diagram showing a relationship between the load of the contact member 111 and the displacement of the contact member 111. A reciprocal of a slope of a graph shown in FIG. 10 indicates a spring constant of the polishing pad 22, i.e., the elastic modulus of the polishing pad 22. The elastic modulus determiner 117 determines the elastic modulus of the polishing pad 22 by dividing a load difference (L2−L1) of the contact member 111 by a displacement difference (D2−D1) of the contact member 111 corresponding to the load difference L2−L1.

When the contact member 111 presses the polishing pad 22, the support arm 120 is bent slightly by receiving a reaction force from the polishing pad 22. Such a bend of the support arm 120 may cause a difference between the measured value of the displacement of the contact member 111 and the actual displacement of the contact member 111.

Figure 11:
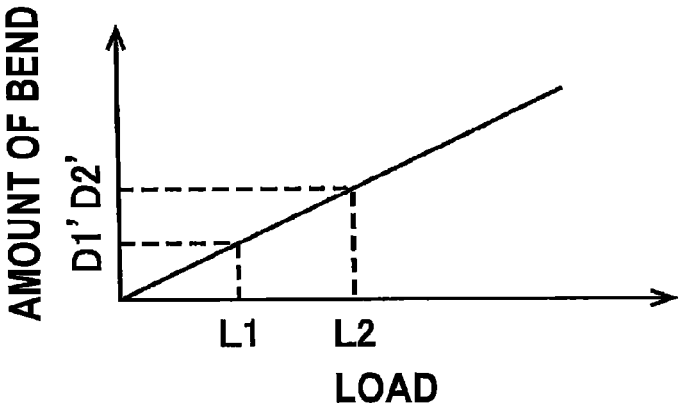
FIG. 11 is a diagram showing a relationship between load of the contact member and amount of bend of a support arm.

Thus, in order to obtain a more accurate elastic modulus, it is preferable to correct the displacement of the contact member 111 using an amount of bend of the support arm 120. More specifically, it is preferable to subtract the amount of bend of the support arm 120 from the measured value of the displacement of the contact member 111. FIG. 11 is a diagram showing a relationship between the load of the contact member 111 applied to the polishing pad 22 and the amount of bend of the support arm 120. As can be seen from FIG. 11, the amount of bend of the support arm 120 is approximately proportional to the load of the contact member 111. Therefore, it is possible to obtain an accurate displacement of the contact member 111 by subtracting a corresponding amount of bend of the support arm 120 from the measured value of the displacement of the contact member 111. This correction method of the displacement of the contact member 111 can also be applied to the case where the pneumatic cylinder 114 is secured to the dresser arm 55, instead of the support shaft 120.

In the example shown in FIG. 11, the amount of bend of the support arm 120 corresponding to the load L1 of the contact member 111 is D1', and the amount of bend of the support arm 120 corresponding to the load L2 of the contact member 111 is D2'. Therefore, the elastic modulus of the polishing pad 22 can be determined by subtracting the amounts D2', D1' of bend of the support arm 120 from the displacement measured values D2, D1 of the contact member 111 corresponding to the loads L2, L1 of the contact member 111, respectively, to thereby correct the displacement of the contact member 111, and dividing the load difference L2−L1 of the contact member 111 by the corrected displacement difference (D2−D2')−(D1−D1') of the contact member 111 that corresponds to the load difference L2−L1. Correction data indicating the relationship between the load of the contact member 111 and the corresponding amount of bend of the support arm 120 is stored in advance in the elastic modulus determiner 117.

The elastic modulus of the polishing pad 22 that has been determined in this manner is transmitted to the polishing condition adjustor 47. This polishing condition adjustor 47 determines an optimal pressure of the retaining ring 82 to be applied to the polishing pad 22 from the determined elastic modulus of the polishing pad 22. This optimal pressure is determined based on a polishing condition data indicating a relationship between the elastic modulus of the polishing pad 22 and the pressure of the retaining ring 82 that can minimize an amount of the rounded edge. This polishing condition data is obtained in advance by polishing a plurality of sample wafers (sample substrates) with respective different pressures of the retaining ring under the condition that the elastic modulus of the polishing pad 22 is kept constant, polishing another group of a plurality of sample wafers (sample substrates) with respective different pressures of the retaining ring under the condition that the elastic modulus of the polishing pad 22 is kept constant at a different value, repeating polishing of a plurality of sample wafers while changing the elastic modulus of the polishing pad 22 in the same manner, measuring the amount of rounded edge of each of the polished sample wafers, establishing an association between the retaining ring pressure and the amount of rounded edge of the sample wafer with respect to each of the elastic moduli, and determining the retaining ring pressure that minimizes the amount of rounded edge of the sample wafer with respect to each of the elastic moduli. The amount of rounded edge can be represented by a difference in a polishing rate or a film thickness between the peripheral portion and other portion of the wafer. The sample wafer may preferably have a structure (e.g., interconnect patterns, type of film, or the like) that is the same as or similar to the structure of the wafer W to be originally polished.

The polishing condition data is stored in advance in the polishing condition adjustor 47. Therefore, the polishing condition adjustor 47 can determine the optimal pressure of the retaining ring 82 corresponding to the elastic modulus of the polishing pad 22 from the measured elastic modulus of the polishing pad 22 and the polishing condition data.

The polishing condition adjustor 47 sends a command signal to the pressure regulator 100 so that the retaining ring 82 presses the polishing pad 22 at the determined pressure. Upon receiving this command signal, the pressure regulator 100 adjusts the pressure of the gas in the retaining ring pressure chamber C6 such that the pressure of the retaining ring 82 becomes the determined pressure. In this manner, the elastic modulus of the polishing pad 22 is reflected in the pressure of the retaining ring 82.

Next, a specific example for obtaining the polishing condition data will be described. Under the condition that the temperature of the polishing pad 22 is adjusted so as to keep the elastic modulus constant, a plurality of sample wafers are polished. These sample wafers are polished with predetermined different pressures of the retaining ring, respectively. After polishing, a film thickness of each of the sample wafers is measured by a film-thickness measuring device (not shown) so that the amount of rounded edge of each sample wafer is obtained. Next, a difference between the pressure of the retaining ring 82 and the polishing pressure on the peripheral portion of the wafer during polishing of the sample wafer is obtained. The pressure of the retaining ring 82 corresponds to the pressure in the pressure chamber C6 shown in FIG. 2, and the polishing pressure on the peripheral portion of the wafer corresponds to the pressure in the pressure chamber C4 shown in FIG. 2.

Figure 12:
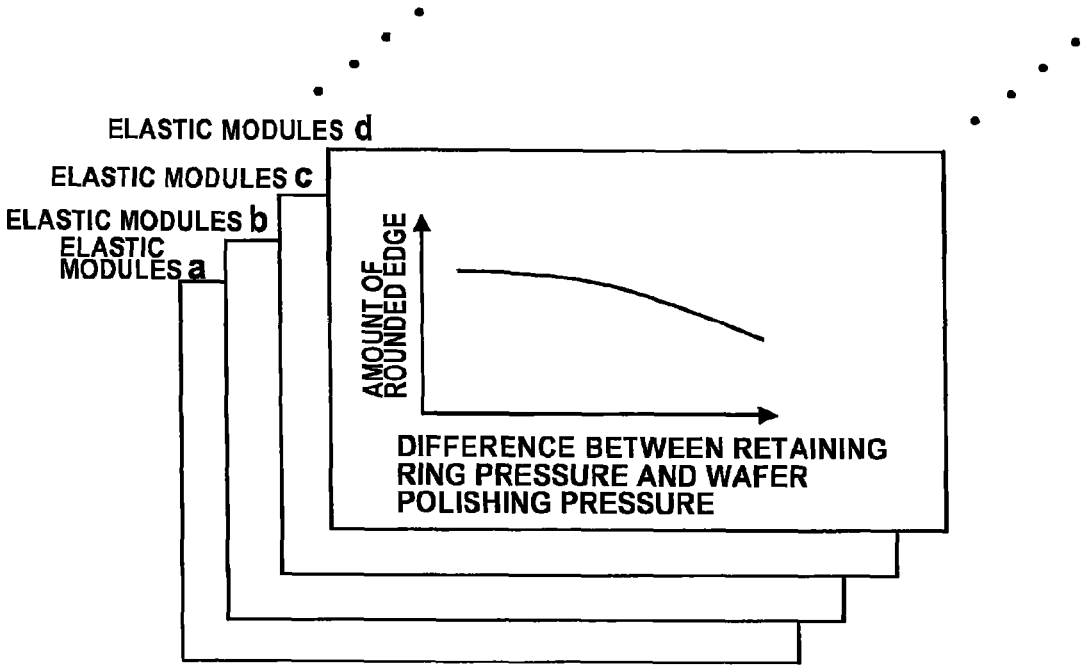
FIG. 12 is a diagram showing measurement data showing a relationship between amount of rounded edge, retaining ring pressure, and polishing pressure on a peripheral portion.
Figure 13:
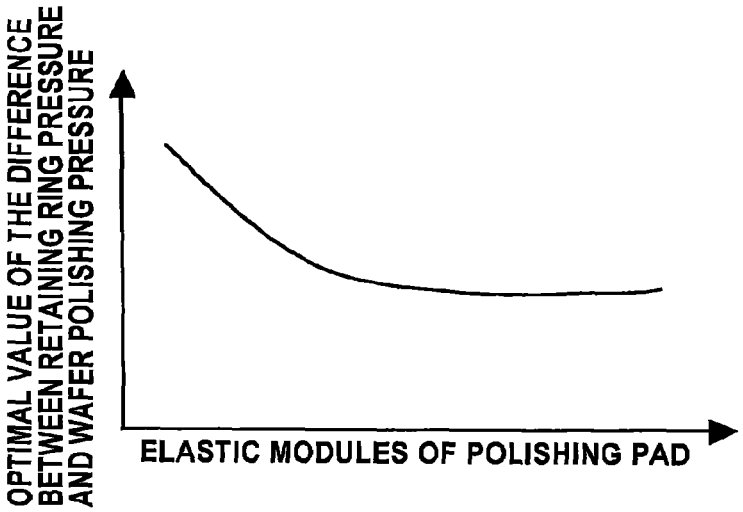
FIG. 13 is a diagram showing a polishing condition data.

In the same manner, while changing the elastic modulus of the polishing pad 22 little by little, a plurality of sample wafers are polished with different pressures of the retaining ring at each elastic modulus, and the amount of rounded edge of each of the sample wafers is measured, so that a plurality of measurement data as shown in FIG. 12 are obtained. Each measurement data shown in FIG. 12 indicates a relationship between the amount of rounded edge and the difference between the pressure of the retaining ring and the polishing pressure on the peripheral portion of the wafer. These measurement data correspond to different elastic moduli. Next, a pressure difference (i.e., a difference between the pressure of the retaining ring 82 and the polishing pressure applied to the peripheral portion of the wafer) that minimizes the amount of rounded edge is determined in each of the elastic moduli of the polishing pad 22, so that the polishing condition data as shown in FIG. 13 is obtained. This polishing condition data indicates the relationship between the elastic modulus of the polishing pad 22 and an optimal value of the difference between the pressure of the retaining ring and the polishing pressure applied to the peripheral portion of the wafer. The polishing condition adjustor 47 determines the optimal value of the pressure difference corresponding to the elastic modulus of the polishing pad 22 measured by the elastic modulus measuring device 110 from the polishing condition data, and determines the pressure of the retaining ring 82 for achieving the determined pressure difference.

Figure 14:
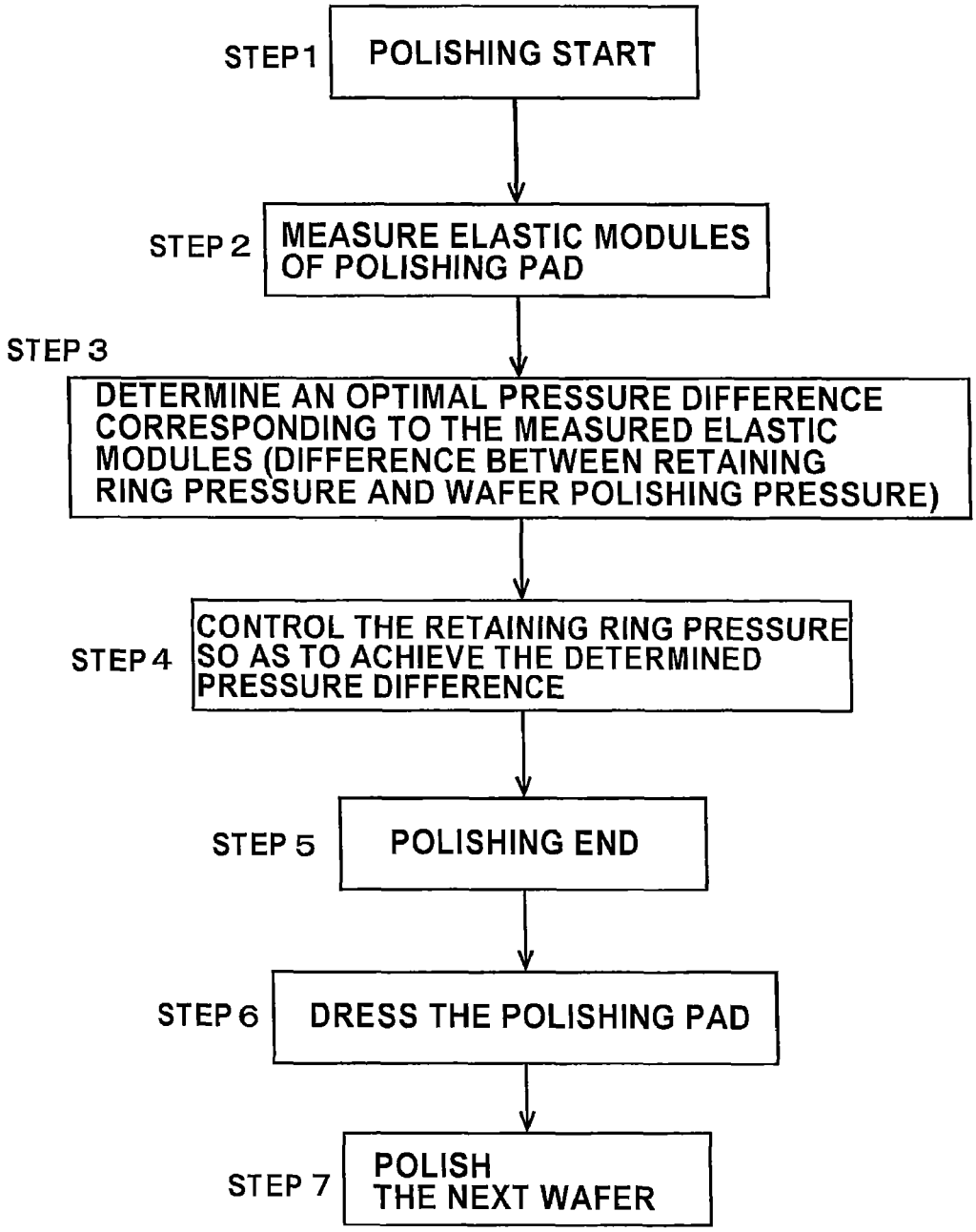
FIG. 14 is a diagram illustrating a process of feeding back the measured elastic modulus of the polishing pad to the polishing condition.

FIG. 14 is a diagram illustrating a process of feeding back the measured elastic modulus of the polishing pad 22 to the polishing condition. When polishing of the wafer is started (step 1), the elastic modulus of the polishing pad 22 is measured (step 2). The polishing condition adjustor 47 determines the optimal pressure difference corresponding to the measured elastic modulus from the above-discussed polishing condition data (step 3). This pressure difference is a difference between the pressure of the retaining ring 82 and the polishing pressure applied to the peripheral portion of the wafer. The polishing condition adjustor 47 then calculates the pressure of the retaining ring 82 for achieving the determined pressure difference, and transmits the calculated pressure value as the target pressure value to the pressure regulator 100. The pressure regulator 100 regulates the pressure in the retaining ring pressure chamber C6 in accordance with this target pressure value (step 4). In this step 4, in order not to apply an excessive force to the wafer, the polishing pressure applied to the wafer, including its peripheral portion, is maintained as it is. It is preferable to repeat the processes from the step 2 to the step 4 several times. After polishing of the wafer is terminated (step 5), the polishing pad 22 is dressed by the dresser 50 (step 6). Then a subsequent wafer is polished in the same manner (step 7).

Since the elastic modulus of the polishing pad 22 varies depending on the temperature of the polishing pad 22, the amount of rounded edge of the wafer can also be controlled by the temperature of the polishing pad 22. Therefore, in addition to the pressure of the retaining ring 82, the temperature of the polishing pad 22 may preferably be used to prevent the rounded edge of the wafer. Thus, an embodiment capable of regulating the temperature of the polishing pad 22 will be described.

Figure 15:
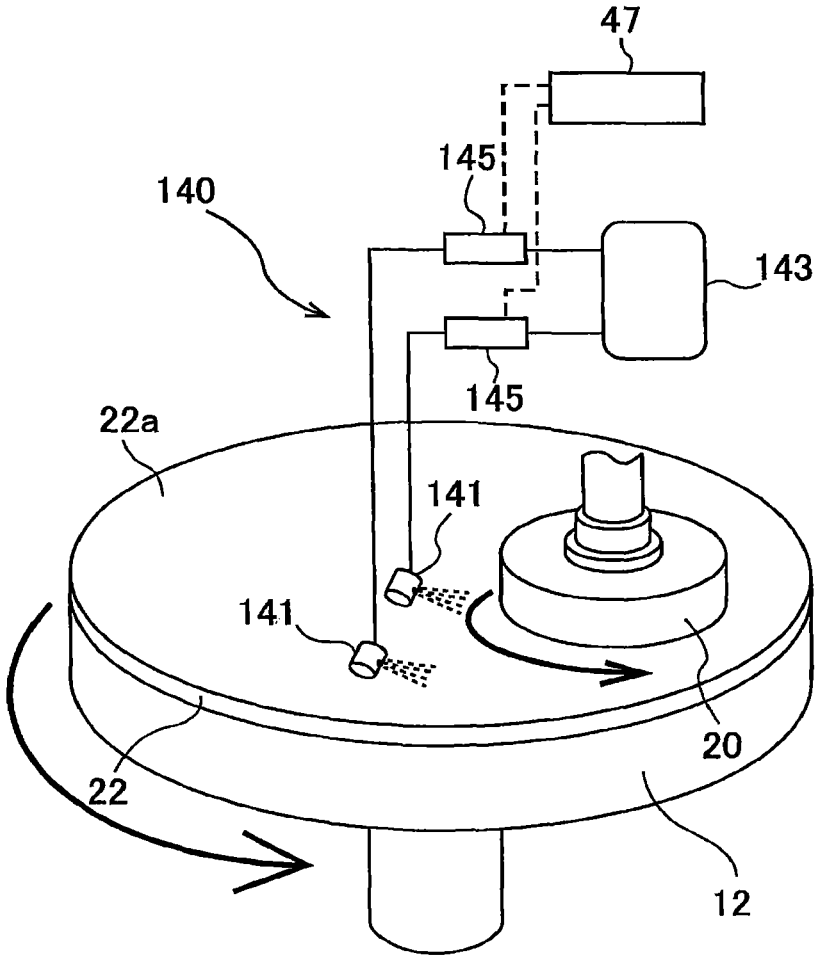
FIG. 15 is a view showing a medium contacting unit for bringing a temperature-regulating medium into contact with a polishing surface of the polishing pad.

FIG. 15 is a view showing a medium contacting unit 140 for bringing a temperature-regulating medium into contact with the polishing surface 22*a* of the polishing pad 22. Other structures of the polishing apparatus that are not shown in the drawing are identical to those of the above-discussed embodiment, and their repetitive descriptions are omitted.

The medium contacting unit 140 has a plurality of medium supply nozzles 141 arranged along the radial direction of the polishing pad 22, a medium supply source 143 for supplying a temperature-regulating medium to the medium supply nozzles 141, and flow-rate regulating valves 145 for regulating flow rate of the temperature-regulating medium delivered from the medium supply source 143 to the medium supply nozzles 141. The medium supply source 143 stores therein the temperature-regulating medium that is maintained within a predetermined temperature range. The flow-rate regulating valves 145 are coupled to the polishing condition adjustor 47, and are operable in accordance with command signals from the polishing condition adjustor 47. The flow rates of the temperature-regulating medium supplied from the respective medium supply nozzles 141 to the polishing pad 22 are regulated independently by these flow-rate regulating valves 145. Therefore, it is possible to regulate the temperature of one or some of multiple regions of the polishing pad 22. The temperature-regulating medium to be used may be clean air, nitrogen, pure water, or mixture of them.

At least one of the medium supply nozzles 141 may preferably supply the temperature-regulating medium to a region of the polishing pad 22 that contacts the peripheral portion of the wafer. Typically, the temperature-regulating medium is a cooling medium for cooling the polishing pad 22. In some cases, a heating medium may be used as the temperature-regulating medium. While FIG. 15 shows the embodiment in which two medium supply nozzles 141 and two flow-rate regulating valves 145 are provided, three or more medium supply nozzles 141 and three or more flow-rate regulating valves 145 may be provided. Further, instead of the multiple medium supply nozzles 141 and the multiple flow-rate regulating valves 145, one medium supply nozzle 141 and one flow-rate regulating valve 145 may be provided. The temperature-regulating medium may be a solid having a temperature-regulating function.

Figure 7:
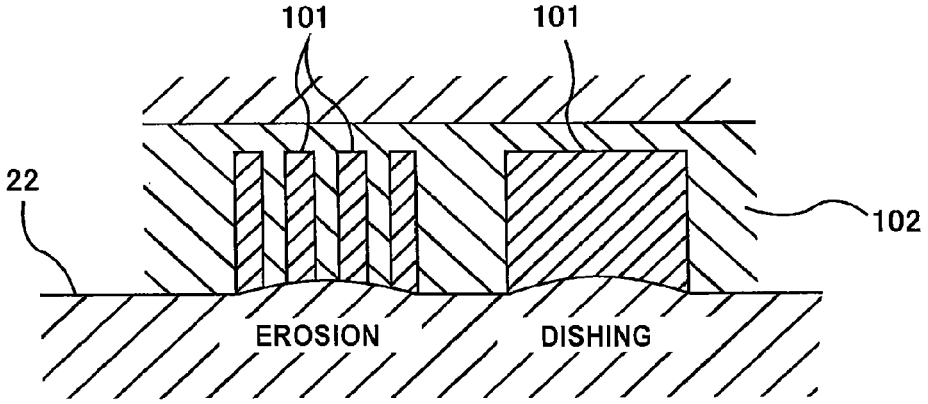
FIG. 7 is a schematic drawing showing erosion and dishing.

Surface steps, such as the erosion and the dishing as shown in FIG. 7, are hardly eliminated by regulating the pressure of the retaining ring 82, but can be eliminated by regulating the temperature of the polishing pad 22. Thus, an embodiment for eliminating the surface steps (i.e., surface irregularities) of the wafer, such as the erosion and the dishing, by regulating the temperature of the polishing pad 22 will be described.

Figure 16:
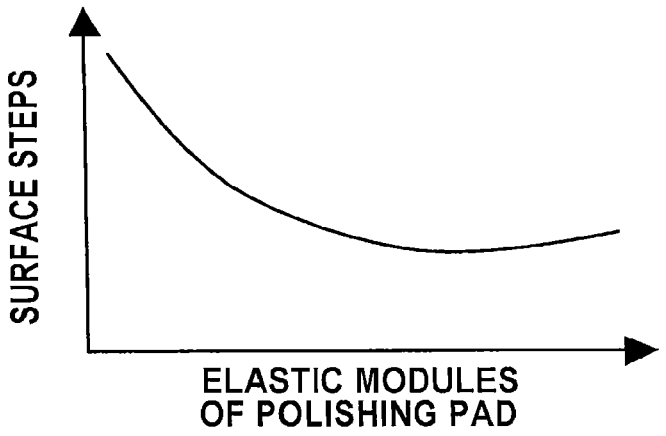
FIG. 16 is a diagram showing the polishing condition data indicating a relationship between the elastic modulus of the polishing pad and surface steps of the wafer.

FIG. 16 is a diagram showing a polishing condition data indicating a relationship between the elastic modulus of the polishing pad 22 and the surface steps of the wafer. This polishing condition data shown in FIG. 16 is obtained in advance by polishing a plurality of sample wafers (sample substrates) under different elastic moduli conditions (other conditions are the same), measuring size of the surface steps of each of the polished sample wafers, and establishing an association between the elastic modulus and the size of the surface steps. The size of the surface steps can be measured with use of a conventional technique, such as a profilometer, an atomic force microscope, or a scanning electron microscope. The polishing condition data that has been obtained in this manner is stored in advance in the polishing condition adjustor 47.

As can be seen from FIG. 16, there exists an elastic modulus of the polishing pad 22 that minimizes the surface steps of the wafer. In other words, this elastic modulus value is an optimal elastic modulus that can minimize the surface steps of the wafer. Thus, the polishing condition adjustor 47 controls the operations of the medium contacting unit 140 to regulate the temperature of the polishing pad 22 such that the elastic modulus of the polishing pad 22, which has been measured by the elastic modulus measuring device 110, becomes the above-described optimal elastic modulus. This optimal elastic modulus is predetermined from the polishing condition data shown in FIG. 16 and is stored beforehand as a target value of the elastic modulus of the polishing pad 22 in the polishing condition adjustor 47.

Figure 17:
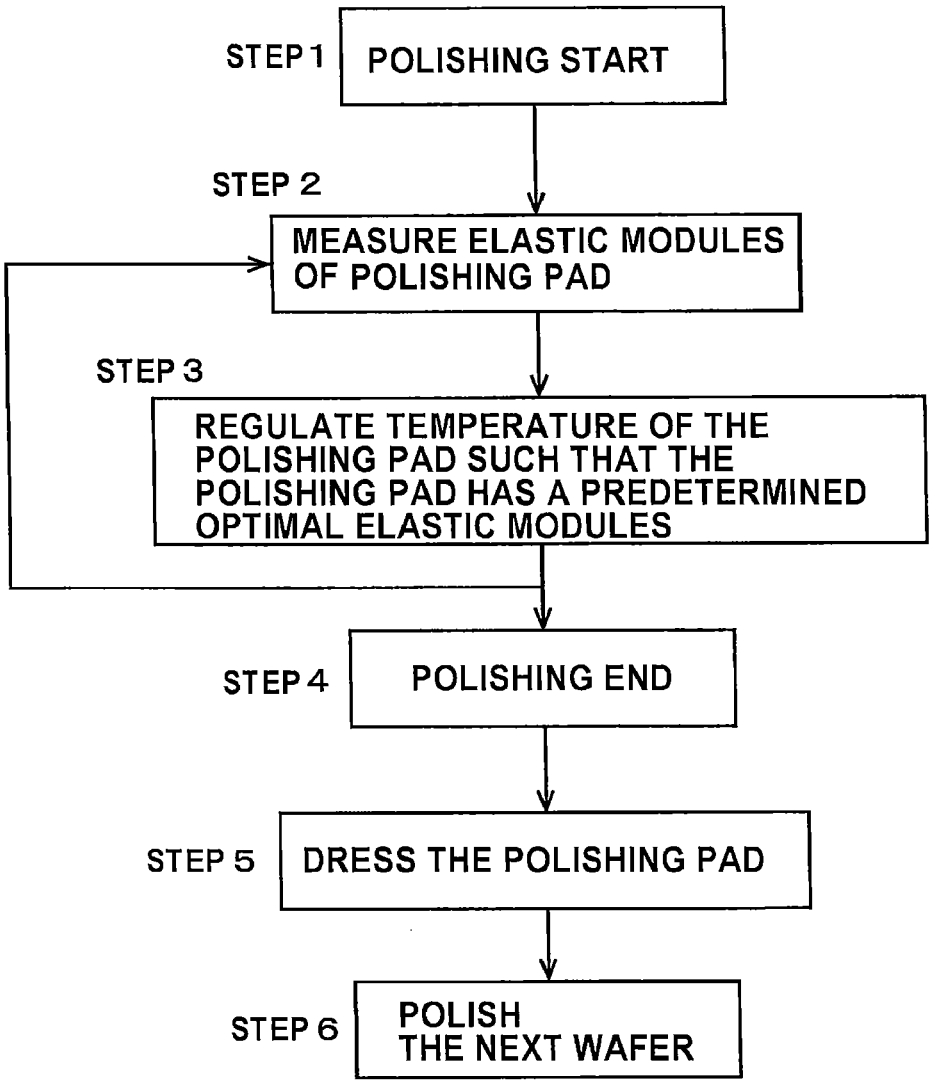
FIG. 17 is a diagram illustrating a process of feeding back the measured elastic modulus of the polishing pad to the polishing condition.

FIG. 17 is a diagram illustrating a process of feeding back the measured elastic modulus of the polishing pad 22 to the polishing condition. When polishing of the wafer is started (step 1), the elastic modulus of the polishing pad 22 is measured (step 2). The polishing condition adjustor 47 regulates the temperature of the polishing pad 22 through the medium contacting unit 140 based on the measured elastic modulus such that the polishing pad 22 has the above-discussed predetermined optimal elastic modulus (step 3). The step 2 and the step 3 are repeated until the measured elastic modulus becomes equal to the predetermined optimal elastic modulus. Preferably, the step 2 and the step 3 are repeated until polishing of the wafer is terminated. After polishing of the wafer is terminated (step 4), the polishing pad 22 is dressed by the dresser 50 (step 5). Then a subsequent wafer is polished in the same manner (step 6).

Figure 18:
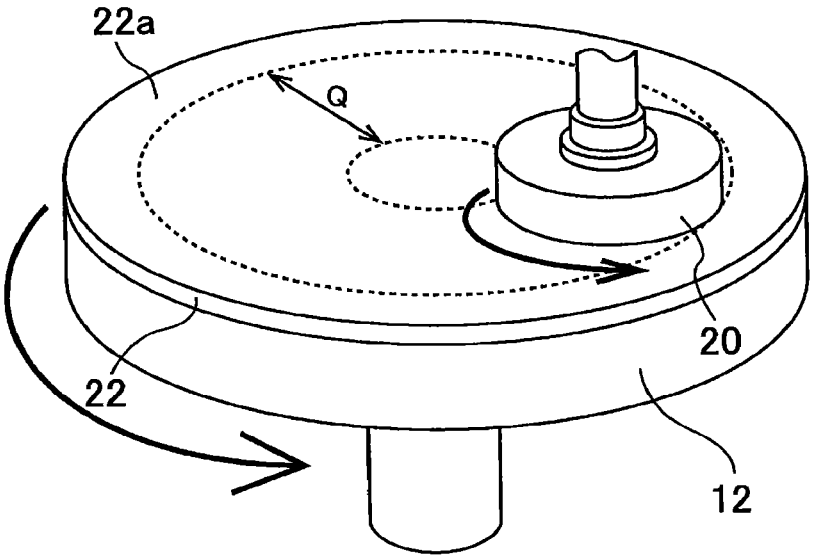
FIG. 18 is a diagram illustrating a preferable zone for measuring the elastic modulus of the polishing pad.

As indicated by a symbol Q in FIG. 18, the elastic modulus of the polishing pad 22 is preferably measured in a region in which the wafer contacts the polishing pad 22. Further, the elastic modulus of the polishing pad 22 is preferably measured in a region upstream of the top ring 20.

Figure 19:
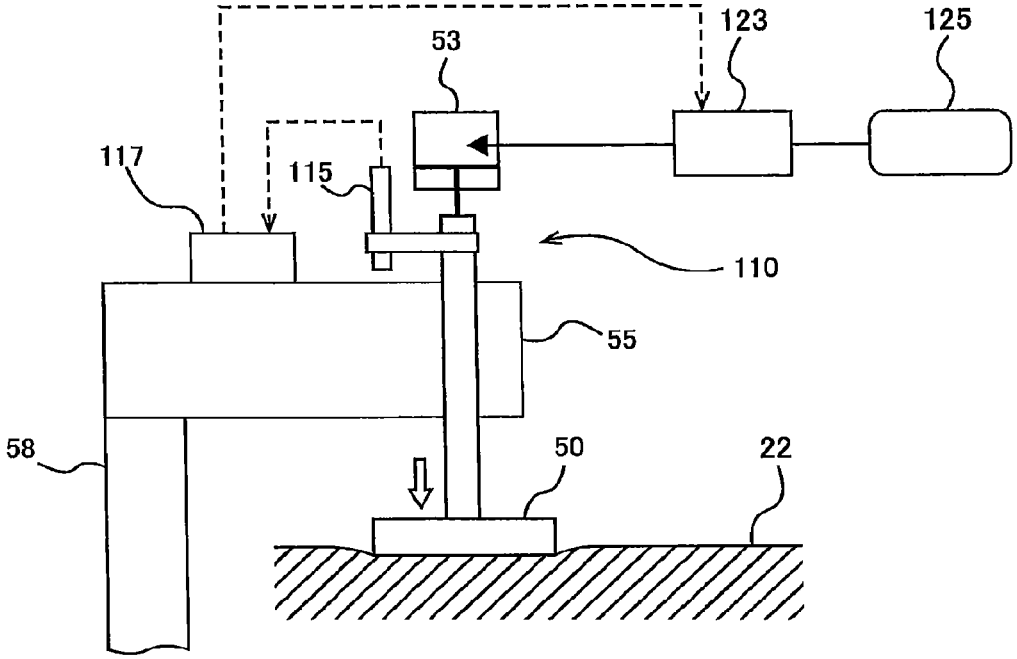
FIG. 19 is a view showing an example of an elastic modulus measuring device for measuring the elastic modulus of the polishing pad with use of a dresser.

FIG. 19 is a view showing an example of the elastic modulus measuring device 110 for measuring the elastic modulus of the polishing pad 22 with use of the dresser 50. As shown in FIG. 19, this elastic modulus measuring device 110 has the pneumatic cylinder 53 as an actuator for pressing the dresser 50 against the polishing pad 22, displacement measuring device 115 for measuring a displacement of the dresser 50 in a vertical direction, and elastic modulus determiner 117 for determining the elastic modulus of the polishing pad 22 from a load of the dresser 50 exerted on the polishing pad 22 and the displacement of the dresser 50. The pneumatic cylinder 53 is coupled to the compressed-gas supply source 125 via the pressure regulator 123, which is configured to regulate the pressure of the compressed gas supplied from the compressed-gas supply source 125 and deliver the compressed gas with the regulated pressure to the pneumatic cylinder 53.

The elastic modulus determiner 117 is operable to send a predetermined target pressure value of the compressed gas to the pressure regulator 123. This pressure regulator 123 operates such that the pressure of the compressed gas delivered to the pneumatic cylinder 53 is maintained at the predetermined target pressure value. The load applied from the dresser 50 to the polishing pad 22 can be calculated from the target pressure value and a pressure-receiving area of the pneumatic cylinder 53.

The displacement measuring device 115 is configured to move vertically together with the dresser 50 relative to the dresser arm 55. A height of the dresser arm 55 is constant, and a vertical position of the dresser arm 55 is fixed. Therefore, the displacement of the dresser 50 can be determined by measuring the displacement of the displacement measuring device 115 relative to the dresser arm 55.

The pneumatic cylinder 53 presses the lower surface (i.e., the dressing surface) of the dresser 50 against the polishing pad 22, and in this state the displacement measuring device 115 measures the displacement of the dresser 50, i.e., the amount of deformation of the polishing pad 22. The elastic modulus determiner 117 calculates the elastic modulus of the polishing pad 22 from the displacement of the dresser 50 and the load of the dresser 50 in the same manner as discussed above. As with the example shown in FIG. 11, the measured value of the displacement of the dresser 50 may be corrected with use of a correction data indicating a relationship between amount of bend of the dresser arm 55 and the load of the dresser 50 applied to the polishing pad 22, in the same manner as discussed above. The dressing process of the polishing pad 22 is typically performed before polishing (i.e., between polishing of a wafer and polishing of a subsequent wafer). Preferably, subsequent to the dressing process, the dresser 50 is pressed against the polishing pad 22 and the displacement of the dresser 50 is measured.

Figure 20:
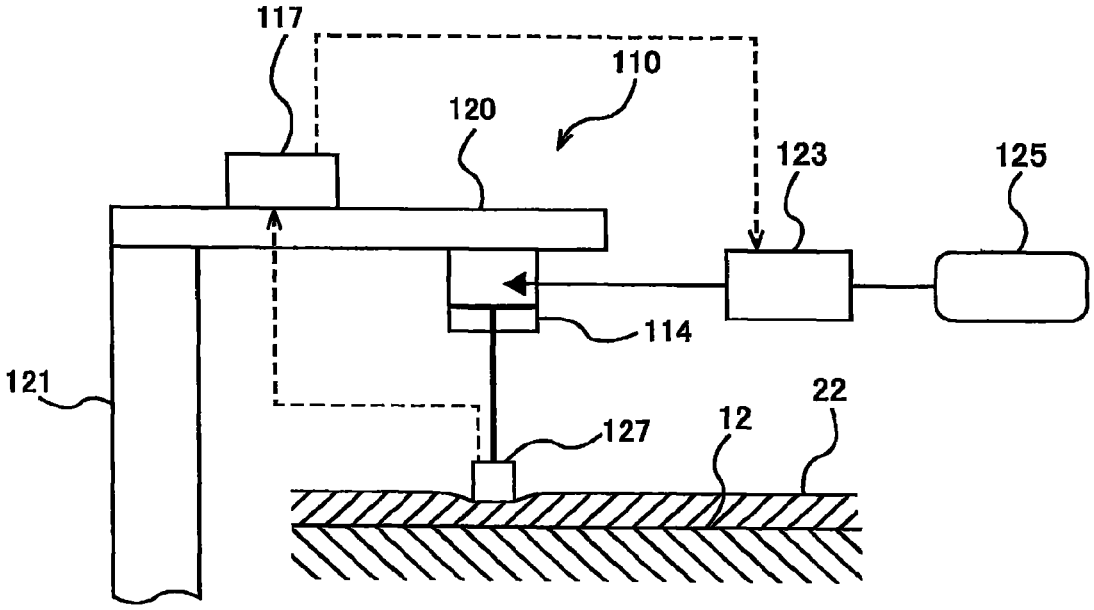
FIG. 20 is a view showing another example of the elastic modulus measuring device.

FIG. 20 is a view showing another example of the elastic modulus measuring device 110. The elastic modulus measuring device 110 in this example has a distance sensor 127 to be brought into contact with the polishing pad 22, pneumatic cylinder 114 as an actuator for pressing the distance sensor 127 against the polishing pad 22, and elastic modulus determiner 117 for determining the elastic modulus of the polishing pad 22 from the displacement of the distance sensor 127 and a load of the distance sensor 127 exerted on the polishing pad 22. In this example, the distance sensor 127 also serves as a contact member to be brought into contact with the polishing pad 22. The pneumatic cylinder 114 is secured to the support arm 120 arranged above the polishing pad 22. The support arm 120 is secured to the support shaft 121 which is provided outside the polishing table 12. The pneumatic cylinder 114 may be secured to the dresser arm 55, instead of the support arm 120.

The pneumatic cylinder 114 is coupled to the compressed-gas supply source 125 via the pressure regulator 123, which is configured to regulate the pressure of the compressed gas supplied from the compressed-gas supply source 125 and deliver the compressed gas with the regulated pressure to the pneumatic cylinder 114. The elastic modulus determiner 117 is operable to send a predetermined target pressure value of the compressed gas to the pressure regulator 123, and the pressure regulator 123 operates such that the pressure of the compressed gas delivered to the pneumatic cylinder 114 is maintained at the predetermined target pressure value. The load applied from the distance sensor 127 to the polishing pad 22 can be calculated from the target pressure value and the pressure-receiving area of the pneumatic cylinder 114.

The distance sensor 127 measures a distance between this distance sensor 127 and the polishing table 12. The displacement of the distance sensor 127 when being pressed against the polishing pad 22 (i.e., the amount of deformation of the polishing pad 22) is an amount of change in the distance between the distance sensor 127 and the polishing table 12. The polishing pad 22 when pressed by the distance sensor 127 is sandwiched between the distance sensor 127 and the polishing table 12. Therefore, the displacement of the distance sensor 127 when pressing the polishing pad 22 can be determined from the change in the distance between the distance sensor 127 and the polishing table 12. More specifically, the displacement of the distance sensor 127, i.e., the amount of deformation of the polishing pad 22, can be determined by measuring a first distance between the distance sensor 127 and the polishing table 12 when the distance sensor 127 is in contact with the polishing pad 22 with substantially no load on the polishing pad 22, measuring a second distance between the distance sensor 127 and the polishing table 12 when the distance sensor 127 is pressing the polishing pad 22 with a predetermined load which is larger than zero, and subtracting the second distance from the first distance. The first distance may be measured at multiple points arranged along a diametral direction of the polishing pad 22, so that a profile of the polishing pad 22 can be obtained.

A non-contact type distance sensor, such as an ultrasonic sensor, is used as the distance sensor 127. In a case where the polishing table 12 has a metal upper surface, an eddy current sensor may be used as the distance sensor 127.

Figure 21:
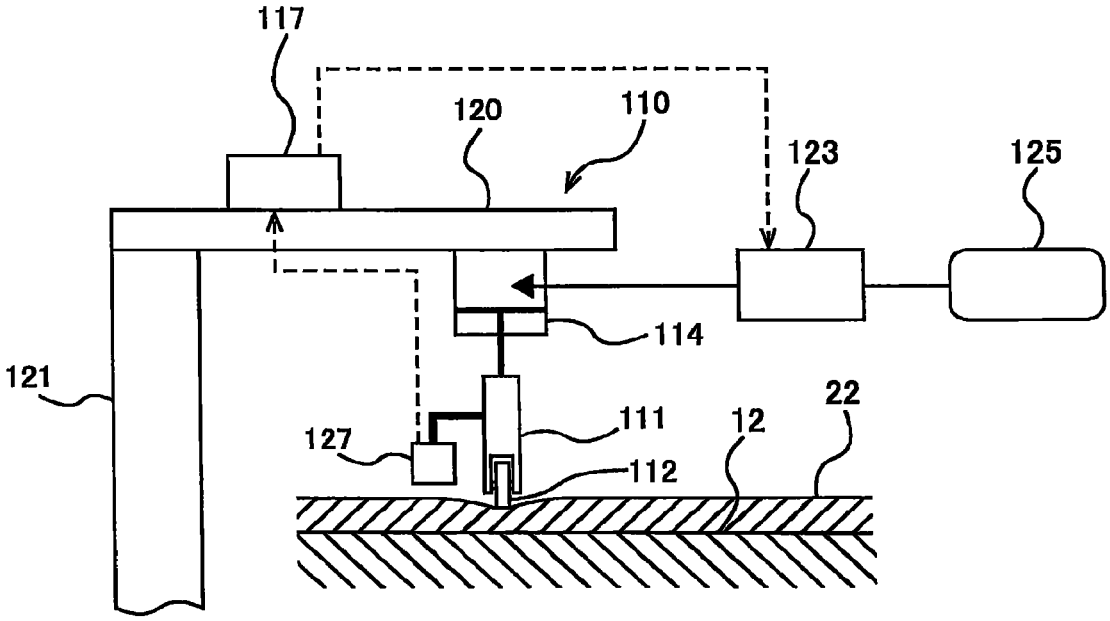
FIG. 21 is a view showing a modified example of the elastic modulus measuring device shown in FIG. 20.

FIG. 21 is a view showing a modified example of the elastic modulus measuring device 110 shown in FIG. 20. In this example, the contact member 111 has a roller 112 rotatably mounted to a tip end of the contact member 111 so that the roller 112 contacts the polishing pad 22. The distance sensor 127 is coupled to the contact member 111 so that the distance sensor 127 and the contact member 111 move together in the vertical direction. The distance sensor 127 is arranged so as to face the surface of the polishing pad 22 and is located away from the surface of the polishing pad 22.

When the roller 112 of the contact member 111 is pressed against the polishing pad 22 by the pneumatic cylinder 114, the distance sensor 127 is moved together with the contact member 111 toward the polishing pad 22. Therefore, as with the example shown in FIG. 20, the distance sensor 127 can measure the displacement of the contact member 111, i.e., the amount of deformation of the polishing pad 22. In this example, since the roller 112 is placed in rolling contact with the polishing pad 22, the damages to the distance sensor 127 and the polishing pad 22 are prevented.

Figure 22:
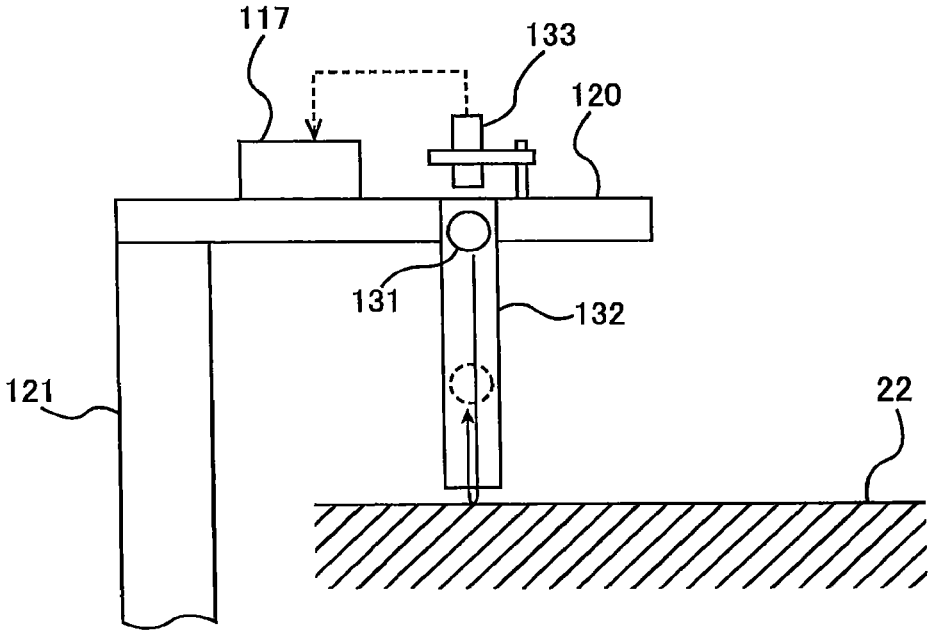
FIG. 22 is a view showing still another example of the elastic modulus measuring device.

FIG. 22 is a view showing still another example of the elastic modulus measuring device 110. In this example, a steel ball 131 is dropped from a predetermined position onto the polishing pad 22, and the elastic modulus of the polishing pad 22 is measured from a rebound height of the steel ball 131. Specifically, the elastic modulus measuring device 110 includes the steel ball 131, a guide tube 132 for guiding the steel ball 131 to the surface of the polishing pad 22, a distance sensor 133 for measuring the rebound height of the steel ball 131, and elastic modulus determiner 117 for determining the elastic modulus of the polishing pad 22 from a measured value of the rebound height of the steel ball 131. The guide tube 132 and the distance sensor 133 are secured to the support arm 120. The guide tube 132 and the distance sensor 133 may be secured to the dresser arm 55, instead of the support arm 120.

An elastic modulus data indicating a relationship between the rebound height and the elastic modulus of the polishing pad 22 is stored in advance in the elastic modulus determiner 117. Therefore, the elastic modulus determiner 117 can determine the elastic modulus of the polishing pad 22 from the measured value of the rebound height of the steel ball 131 transmitted from the distance sensor 133 and the elastic modulus data.

The elastic modulus measuring device 110 shown in FIG. 8 through FIG. 22 is a contact-type elastic modulus measuring device which is configured to contact the polishing pad 22 so as to measure the elastic modulus of the polishing pad 22. Instead of this contact type, the elastic modulus measuring device 110 may be of non-contact type which is configured to measure the elastic modulus of the polishing pad 22 without contacting the polishing pad 22. Because the non-contact type elastic modulus measuring device 110 does not entail particles or dust that could be generated due to the contact with the polishing pad 22, this type of elastic modulus measuring device 110 can be suitably used during polishing of the wafer.

Figure 23:
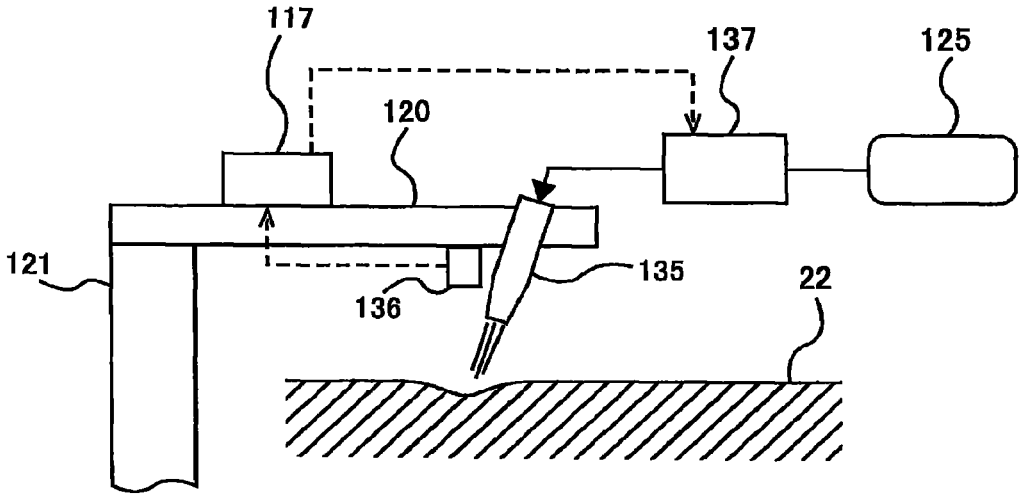
FIG. 23 is a view showing a non-contact type elastic modulus measuring device.

FIG. 23 is a view showing the non-contact type elastic modulus measuring device 110. This elastic modulus measuring device 110 has a blower 135 configured to blow a pressurized gas onto the polishing pad 22 to form a recess on the polishing pad 22, a distance sensor 136 for measuring a depth of the recess, and elastic modulus determiner 117 for determining the elastic modulus of the polishing pad 22 from a measured value of the depth of the recess. A non-contact type distance sensor, such as a laser distance sensor, is used as the distance sensor 136. The blower 135 and the distance sensor 136 are secured to the support arm 120. The blower 135 and the distance sensor 136 may be secured to the dresser arm 55, instead of the support arm 120.

The blower 135 is coupled to the compressed-gas supply source 125 via a flow regulating valve 137. This flow regulating valve 137 is configured to regulate a flow rate of the compressed gas supplied from the compressed-gas supply source 125 to the blower 135. The elastic modulus determiner 117 transmits a predetermined target flow rate value of the compressed gas to the flow regulating valve 137, which regulates the flow rate of the compressed gas in accordance with this target flow rate value.

The elastic modulus determiner 117 stores in advance an elastic modulus data indicating a relationship between the depth of the recess of the polishing pad 22 (i.e., the amount of deformation of the polishing pad 22) and the elastic modulus of the polishing pad 22. The elastic modulus determiner 117 determines the elastic modulus of the polishing pad 22 from the measured value of the depth of the recess obtained by the distance sensor 136 and the elastic modulus data. This elastic modulus measuring device 110 can measure the elastic modulus of the polishing pad 22 without contacting the polishing pad 22. Therefore, this non-contact type elastic modulus measuring device 110 can measure the elastic modulus of the polishing pad 22 without forming scratches to the wafer.

Figure 24:
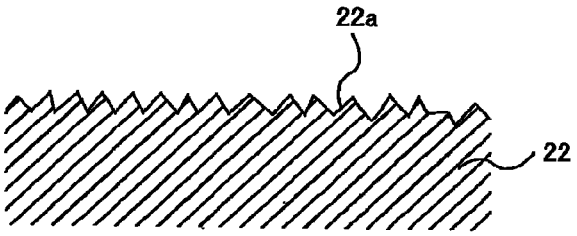
FIG. 24 is a schematic view showing a polishing surface of the polishing pad.

The surface of the polishing pad 22, i.e., the polishing surface 22*a*, has fine irregularities as a result of being dressed by the dresser 50, as shown in FIG. 24. The irregularities of the polishing surface 22*a* may cause a difference in the elastic modulus of the polishing pad 22 between the surface and the interior of the polishing pad 22. As described above, the wafer polishing result can be affected by the elastic modulus of the polishing pad 22. In particular, the profile of the peripheral portion of the wafer is greatly affected by the elastic modulus of the surface of the polishing pad 22. Thus, the next embodiment provides a method of measuring the elastic modulus of the surface of the polishing pad 22.

Figure 25:
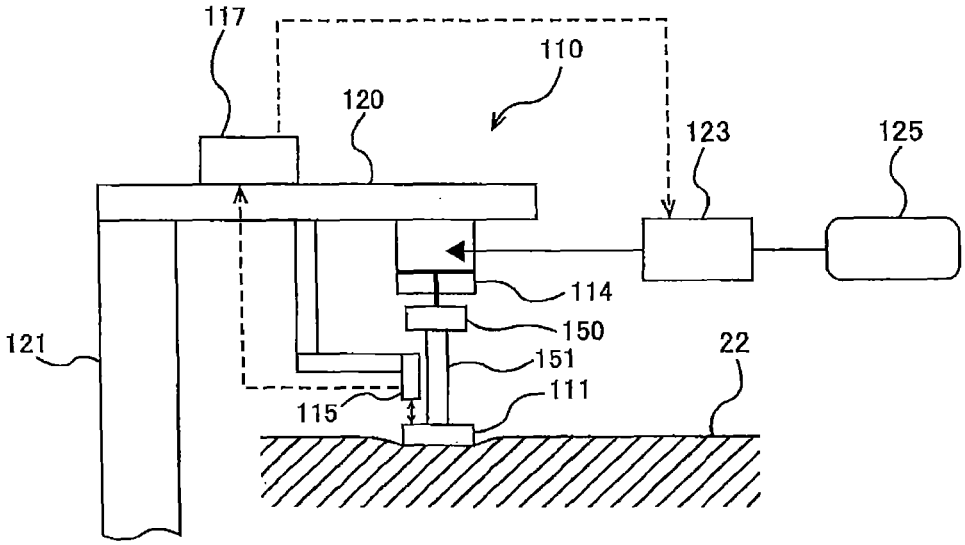
FIG. 25 is a schematic view showing another example of the elastic modulus measuring device.

FIG. 25 is a schematic view showing another example of the elastic modulus measuring device. Structures of the polishing apparatus in this embodiment that are not described particularly are identical to those of the above-discussed embodiment shown in FIG. 8, and their repetitive descriptions are omitted. The elastic modulus measuring device 110 has contact member 111 to be brought into contact with the polishing pad 22, pneumatic cylinder 114 as an actuator for pressing the contact member 111 against the polishing pad 22, displacement measuring device 115 for measuring the displacement of the contact member 111, a load cell 150 as a load measuring device for measuring a load applied from the contact member 111 to the polishing pad 22, and elastic modulus determiner 117 for determining the elastic modulus of the polishing pad 22 from the displacement of the contact member 111 and the load of the contact member 111 exerted on the polishing pad 22.

The pneumatic cylinder 114 is secured to the support arm 120 arranged above the polishing pad 22. The support arm 120 is secured to the support shaft 121 which is provided outside the polishing table 12. The pneumatic cylinder 114 may be secured to the dresser arm 55, instead of the support arm 120. The contact member 111 is secured to a lower end of a shaft 151, and the load cell 150 is secured to an upper end of the shaft 151. The load cell 150 is located between the shaft 151 and a rod of the pneumatic cylinder 114. Therefore, a downward force generated by the pneumatic cylinder 114 is transmitted to the contact member 111 through the load cell 150 and the shaft 151. The contact member 111 has a circular lower surface, which is brought into contact with the polishing surface 22*a* of the polishing pad 22. The lower surface of the contact member 111 may have other shape, such as a rectangular shape. The load applied from the contact member 111 to the polishing pad 22 is measured by the load cell 150.

The displacement measuring device 115 is coupled to the support arm 120, and the vertical position of the displacement measuring device 115 is fixed. The displacement measuring device 115 measures the position of the contact member 111 relative to the support arm 120. The displacement measuring device 115 may be coupled to the contact member 111 so as to be able to move vertically together with the contact member 111, as shown in FIG. 8.

Figure 26:
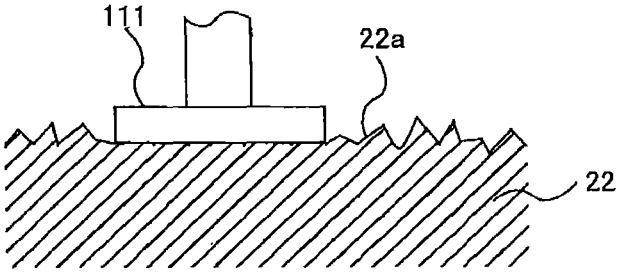
FIG. 26 is a schematic view showing the polishing surface of the polishing pad when pressed by the contact member.
Figure 27:
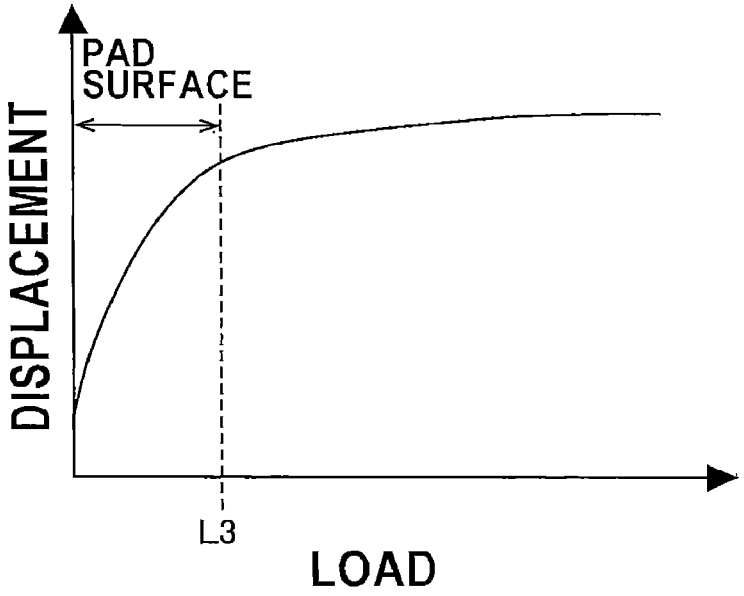
FIG. 27 is a diagram showing a change in the displacement and the load of the contact member when pressing the polishing pad shown in FIG. 24 and FIG. 26.

As shown in FIG. 26, when the contact member 111 presses the polishing surface 22*a* of the polishing pad 22, protrusions of the irregularities of the polishing surface 22*a* are firstly crushed by the lower surface of the contact member 111. After the protrusions are crushed, the polishing pad 22 in its entirety is compressed in its thickness direction. FIG. 27 is a diagram showing a relationship between the displacement and the load of the contact member 111. As can be seen from FIG. 27, an increase in the displacement per unit load (which will be hereinafter referred to as a displacement rate) changes greatly around a load L3 at which the protrusions of the polishing surface 22*a* are crushed. Specifically, the displacement rate is high from when the contact member 111 is brought into contact with the polishing pad 22 until the protrusions of the polishing surface 22*a* are crushed, while the displacement rate is low after the protrusions of the polishing surface 22*a* are crushed. Therefore, it is possible to detect, from the change in the displacement rate, that the protrusions of the polishing surface 22*a* are crushed.

In this specification, the elastic modulus of the surface of the polishing pad 22 is defined as an elastic modulus which is calculated from the load and the displacement of the contact member 111 that are obtained from when the contact member 111 is brought into contact with the polishing pad 22 until the protrusions of the polishing surface 22*a* are crushed. The elastic modulus determiner 117 determines the load and the displacement of the contact member 111 at which the decreasing displacement rate reaches a predetermined threshold value, and calculates the elastic modulus of the surface of the polishing pad 22 from the determined load and the displacement. Since the displacement rate is a reciprocal of the elastic modulus, the elastic modulus determiner 117 may calculate the elastic modulus per unit load, determine the load and the displacement of the contact member 111 at which the increasing elastic modulus reaches a predetermined threshold value, and calculate the elastic modulus of the surface of the polishing pad 22 from the determined load and the displacement.

Figure 28:
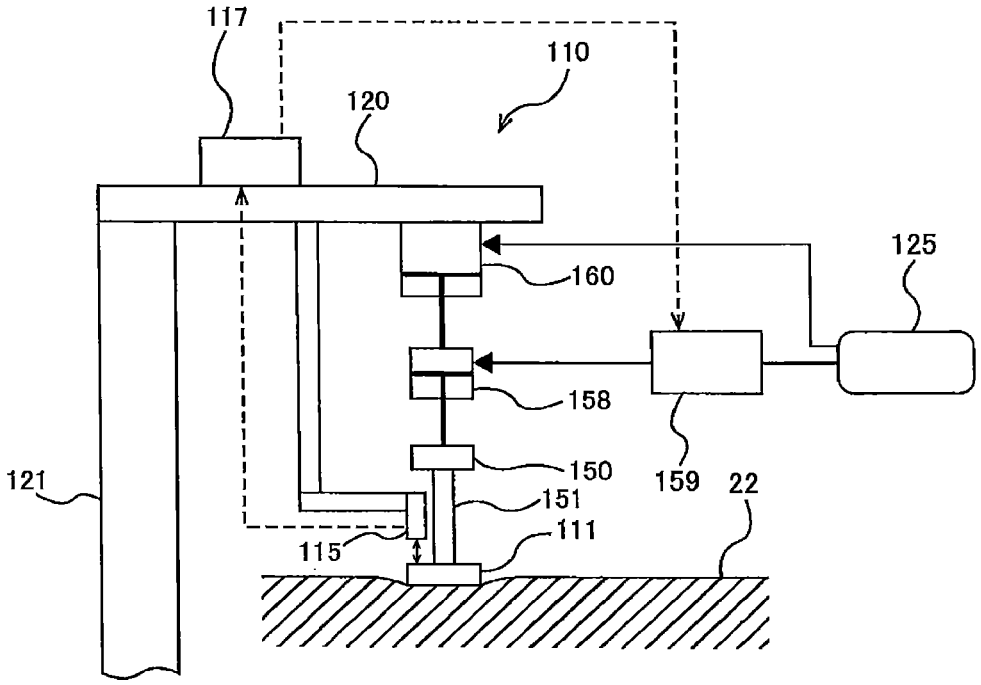
FIG. 28 is a view showing a modified example of the elastic modulus measuring device shown in FIG. 25.

FIG. 28 is a view showing a modified example of the elastic modulus measuring device shown in FIG. 25. Since the size of the irregularities formed on the polishing surface 22*a* of the polishing pad 22 is on the order of μm, it is necessary to precisely press the contact member 111 against the polishing surface 22*a*. The elastic modulus measuring device shown in FIG. 28 is configured to more precisely control a force of the contact member 111 pressing the polishing surface 22*a*. Structures shown in FIG. 28 which are not described particularly are identical to the structures shown in FIG. 25.

As shown in FIG. 28, the load cell 150 is coupled to a pneumatic cylinder 158 as an actuator for pressing the contact member 111 against the polishing pad 22. A low-frictional material is used in sliding contact portions of a cylinder part and a piston part of the pneumatic cylinder 158, so that a piston rod of the pneumatic cylinder 158 can move smoothly upon receiving the gas pressure. The pneumatic cylinder 158 is coupled to the compressed-gas supply source 125 via an electropneumatic regulator 159.

The pneumatic cylinder 158 is coupled to a pneumatic cylinder 160 serving as a contact-member moving device for moving the contact member 111 to a predetermined position. This pneumatic cylinder 160 is also coupled to the compressed-gas supply source 125, but an electropneumatic regulator is not provided between the pneumatic cylinder 160 and the compressed-gas supply source 125. The pneumatic cylinder 160 is configured to move the pneumatic cylinder 158, the load cell 150, and the contact member 111 together to a predetermined position. In this predetermined position, the contact member 111 does not contact the polishing pad 22. In this state, the gas (e.g., air), having a pressure regulated by the electropneumatic regulator 159, is supplied to the pneumatic cylinder 158, so that the pneumatic cylinder 158 presses the contact member 111 against the polishing pad 22. In this manner, the vertical movement of the contact member 111 is performed by the pneumatic cylinder 160, and pressing of the contact member 111 against the polishing pad 22 is performed by the pneumatic cylinder 158. The contact-member moving device may be a combination of a ball screw and a servomotor, instead of the pneumatic cylinder 160.

Figure 29:
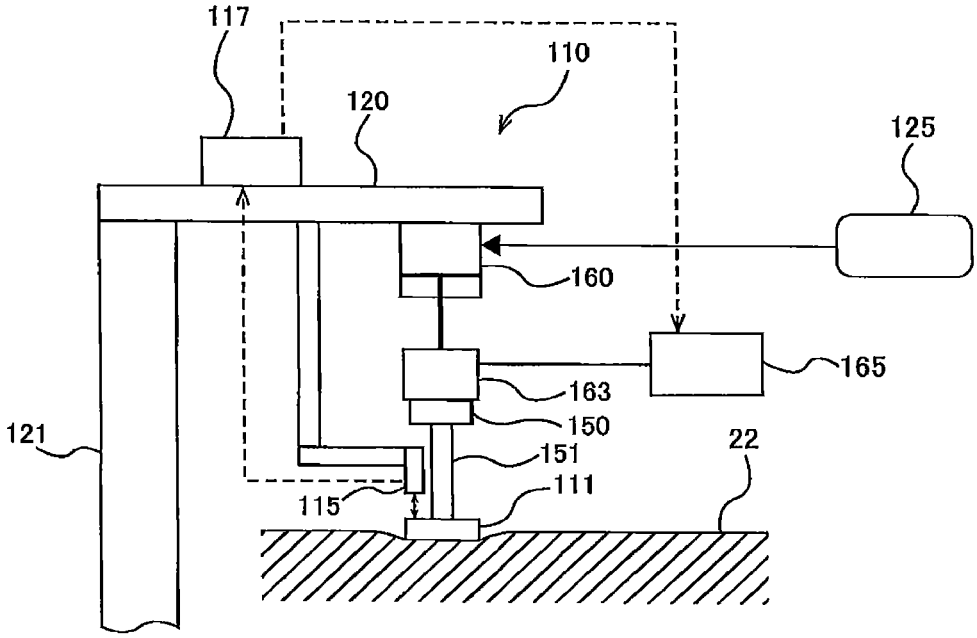
FIG. 29 is a view showing another modified example of the elastic modulus measuring device shown in FIG. 25.

FIG. 29 is a view showing another modified example of the elastic modulus measuring device shown in FIG. 25. This elastic modulus measuring device uses a piezoelectric element 163, instead of the pneumatic cylinder 158. The piezoelectric element 163 is coupled to a power source 165, which applies a variable voltage to the piezoelectric element 163. The piezoelectric element 163 is a device that changes its shape in response to the voltage applied. An amount of change in the shape of the piezoelectric element 163 is on the order of μm. Therefore, the piezoelectric element 163 can precisely regulate the pressing force of the contact member 111. In this example, the vertical movement of the contact member 111 is performed by the pneumatic cylinder 160, and pressing of the contact member 111 against the polishing pad 22 is performed by the piezoelectric element 163.

Figure 30:
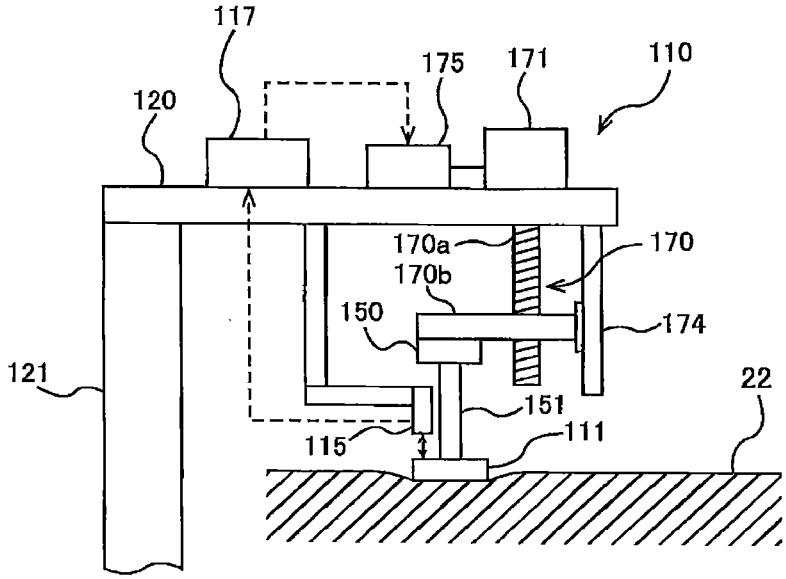
FIG. 30 is a view showing still another modified example of the elastic modulus measuring device shown in FIG. 25.

FIG. 30 is a view showing still another modified example of the elastic modulus measuring device shown in FIG. 25. This elastic modulus measuring device uses a combination of a ball screw 170 and a servomotor 171, which serves not only as the actuator for pressing the contact member 111 against the polishing pad 22, but also as the contact-member moving device for moving the contact member 111. The ball screw 170 has a screw shaft 170*a* and a nut 170*b* which engages with the screw shaft 170*a*. The nut 170*b* is coupled to the load cell 150. Further, the nut 170*b* is supported by a vertically-extending linear guide rail 174 which allows the nut 170*b* to move in the vertical direction.

The servomotor 171 is secured to the support arm 120. A motor driver 175 is coupled to the servomotor 171. This motor driver 175 is configured to drive the servomotor 171 when receiving a command from the elastic modulus determiner 117. The combination of the ball screw 170 and the servomotor 171 can move the contact member 111 in the vertical direction on the order of μm. Therefore, the combination of the ball screw 170 and the servomotor 171 can regulate the pressing force of the contact member 111 precisely.

When the temperature-regulating medium contacts the polishing surface 22*a* of the polishing pad 22 as shown in FIG. 15, the elastic modulus of the surface of the polishing pad 22 is likely to change. Therefore, the elastic modulus measuring device shown in FIG. 25 through FIG. 30 may preferably be combined with the medium contacting unit 140 shown in FIG. 15.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A method for adjusting a temperature of a polishing pad, said method comprising:

providing a polishing pad to polish a substrate, a top ring to hold the substrate, and a temperature adjusting mechanism to control a temperature of the polishing pad;

measuring an elastic modulus of the polishing pad;

adjusting the temperature of the polishing pad so that a target value of the elastic modulus of the polishing pad is reached, the target value being determined based on a relationship between a measured value of the elastic modulus of the polishing pad and a size of a surface of the substrate; and repeating said measuring and said adjusting until the measured value of the elastic modulus corresponds with the target value.

2. The method for adjusting the temperature of the polishing pad according to claim 1, wherein the relationship is determined in advance by:

preparing a plurality of the polishing pads, the elastic modulus of each individual polishing pad being different from any other polishing pad, selecting one of the polishing pads, measuring a size of surface steps of a sample substrate, repeating selecting of one of the polishing pads, polishing of the sample substrate on the selected one of the polishing pads, and measuring of the size of the surface steps of the sample substrate, and determining an optimum elastic modulus of each of the polishing pads at which the size of the surface steps is minimized.

3. The method for adjusting the temperature of the polishing pad according to claim 1, wherein the temperature of the polishing pad is regulated such that the elastic modulus becomes equal to a predetermined target value.

4. The method for adjusting the temperature of the polishing pad according to claim 1, wherein the temperature of the polishing pad is regulated by bringing a temperature-regulating medium into contact with the polishing pad.

5. The method for adjusting the temperature of the polishing pad according to claim 4, wherein the temperature-regulating medium is brought into contact with a plurality of regions of the polishing pad separately.

6. The method for adjusting the temperature of the polishing pad according to claim 5, wherein at least one of the plurality of regions is a region that contacts a peripheral portion of the substrate.

7. The method for adjusting the temperature of the polishing pad according to claim 1, wherein the measuring an elastic modulus of the polishing pad comprises measuring an elastic modulus of the polishing pad during polishing of the substrate.

8. The method for adjusting the temperature of the polishing pad according to claim 7, wherein the measuring an elastic modulus of the polishing pad comprises measuring an elastic modulus of the polishing pad in a region upstream of the substrate with respect to a movement direction of the polishing pad.

9. The method for adjusting the temperature of the polishing pad according to claim 1, wherein the measuring an elastic modulus of the polishing pad comprises measuring an elastic modulus of the polishing pad before polishing of the substrate.

10. The method for adjusting the temperature of the polishing pad according to claim 1, wherein the measuring an elastic modulus of the polishing pad comprises:

applying a force to a surface of the polishing pad to deform the polishing pad, measuring an amount of deformation of the polishing pad, and dividing the force by the amount of deformation of the polishing pad to determine the elastic modulus of the polishing pad.

11. The method for adjusting the temperature of the polishing pad according to claim 1, wherein measuring the elastic modulus of the polishing pad comprises blowing a pressurized gas onto the polishing pad to form a recess in the polishing pad and measuring a depth of the recess.

* * * * *